US007748245B2

(12) United States Patent
Horton et al.

(10) Patent No.: US 7,748,245 B2
(45) Date of Patent: Jul. 6, 2010

(54) ROTARY PAWL LATCH

(75) Inventors: Richard Horton, Stourbridge (GB); Jason Lieu, Redditch (GB)

(73) Assignee: Southco, Inc., Concordville, PA (US)

( * ) Notice: Subject to any disclaimer, the term of this patent is extended or adjusted under 35 U.S.C. 154(b) by 543 days.

(21) Appl. No.: 11/575,468

(22) PCT Filed: Sep. 16, 2005

(86) PCT No.: PCT/US2005/033211

§ 371 (c)(1), (2), (4) Date: Mar. 16, 2007

(87) PCT Pub. No.: WO2006/034057

PCT Pub. Date: Mar. 30, 2006

(65) Prior Publication Data

US 2009/0179438 A1 Jul. 16, 2009

Related U.S. Application Data

(60) Provisional application No. 60/611,409, filed on Sep. 19, 2004.

(51) Int. Cl.
*E05B 13/00* (2006.01)

(52) U.S. Cl. ..... 70/208; 70/210; 70/467; 70/469; 70/489; 70/DIG. 54; 292/224; 292/336.3; 292/DIG. 31; 292/DIG. 61

(58) Field of Classification Search ..... 70/208, 70/210, 218, 224, 467, 469, 471, 483–485, 70/489, 150, 153, DIG. 33, DIG. 54, DIG. 55; D8/331; 292/170, 173, 224, 336.3, DIG. 31, 292/DIG. 61, DIG. 72
See application file for complete search history.

(56) References Cited

U.S. PATENT DOCUMENTS

| | | | | |
|---|---|---|---|---|
| 4,192,536 | A | 3/1980 | Laureano | |
| 4,268,076 | A | 5/1981 | Itoi | |
| 4,343,501 | A * | 8/1982 | Meeks | 292/336.3 |
| 4,510,779 | A * | 4/1985 | Ahad | 70/208 |
| 4,813,722 | A * | 3/1989 | Viscome et al. | 292/216 |
| 5,046,340 | A | 9/1991 | Weinerman et al. | |
| 5,263,750 | A * | 11/1993 | Smith et al. | 292/336.3 |
| 5,411,302 | A | 5/1995 | Shimada | |
| 5,413,391 | A | 5/1995 | Clavin et al. | |
| 5,794,994 | A * | 8/1998 | Miyagawa et al. | 292/336.3 |
| 5,927,772 | A | 7/1999 | Antonucci et al. | |
| 5,941,104 | A | 8/1999 | Sadler | |

(Continued)

FOREIGN PATENT DOCUMENTS

| | | |
|---|---|---|
| EP | 0239229 A3 | 2/1987 |
| WO | WO0138671 | 5/2001 |
| WO | WO2006034057 | 3/2006 |

*Primary Examiner*—Lloyd A Gall
(74) *Attorney, Agent, or Firm*—Paul & Paul

(57) ABSTRACT

A latch assembly for releasably securing a first member in a closed position relative to a second member is disclosed. The latch assembly includes a frame, a rotary pawl, a locking member, a handle, and a lock plug. The frame is adapted for attachment to the first member. The handle is pivotally attached to the frame and is movable between a closed position and an open position. The locking member retains the pawl in the latched position when the locking member is in an undeflected configuration. The handle causes the locking member to deflect and release the pawl from a latched position when the locking member is in an unlocked position and the handle is moved to the open position. The lock barrel is supported by the frame and can selectively move the locking member to a locked position where the locking member cannot be actuated by the handle.

19 Claims, 32 Drawing Sheets

U.S. PATENT DOCUMENTS

| | | | |
|---|---|---|---|
| 5,984,383 | A | 11/1999 | Parikh et al. |
| 6,048,006 | A | 4/2000 | Antonucci et al. |
| 6,139,073 | A | 10/2000 | Heffner et al. |
| 6,460,902 | B1 | 10/2002 | Kyle |
| 6,471,260 | B1 | 10/2002 | Weinerman et al. |
| 6,761,382 | B2 | 7/2004 | Ji et al. |
| D506,120 | S | 6/2005 | Straka, Jr. et al. |
| 6,942,259 | B2 | 9/2005 | Marzolf et al. |
| 7,004,517 | B2 | 2/2006 | Vitry et al. |
| 7,065,992 | B2 | 6/2006 | Talukdar et al. |
| 7,080,531 | B2 | 7/2006 | Vitry et al. |
| 7,185,927 | B2 | 3/2007 | Talukdar et al. |
| 2003/0025339 | A1 | 2/2003 | Vitry et al. |
| 2003/0193199 | A1 | 10/2003 | Talukdar et al. |
| 2005/0067840 | A1 | 3/2005 | Koveal et al. |
| 2007/0216173 | A1 | 9/2007 | Vitry |

* cited by examiner 140
128
144
220
192
220
130

104
126
132
128
220
192
220
224
175

104
192
220
128
130
114
118
175
120
116

170
105
122
124
107
103
102
101

110
102
170
122
182
101

102
101
182
170
109

ROTARY PAWL LATCH

CROSS REFERENCE TO RELATED APPLICATIONS

This application claims the benefit of the priority of U.S. Provisional Application for Patent No. 60/611,409, filed on Sep. 19, 2004, which is incorporated herein by reference in its entirety.

BACKGROUND OF THE INVENTION

1. Field of Invention

The present invention relates to the field of latch assemblies.

2. Brief Description of the Related Art

Latch assemblies are relied on in many applications for securing items, such as panels, doors, and doorframes together. For example, containers, cabinets, closets, compartments and the like may be secured with a latch. An important use for latches is in the automotive field, where there is a desire and need to access automotive compartments, such as, for example, the trunk or passenger compartments of vehicles, as well as interior compartments such as a glove box. Various latches for panel closures have been employed where one of the panels such as a swinging door or the like is to be fastened or secured to a stationary panel, doorframe, or compartment body. An example of such a latch can be seen in U.S. Pat. No. 5,927,772, issued on Jul. 27, 1999, which is incorporated herein by reference in its entirety. Although many latch assemblies are known in the prior art, none are seen to teach or suggest the unique features of the present invention or to achieve the advantages of the present invention.

SUMMARY OF THE INVENTION

The present invention is directed to a latching system for securing two members together. The present invention includes a housing, a rotary pawl, catch means for releasably holding the pawl in a closed configuration, and means for operating the catch means. The pawl is pivotally attached to the housing and is rotationally movable between a closed or engaged configuration and an open or disengaged configuration. The pawl is provided with a torsion spring member that biases the pawl toward the open or disengaged configuration. The catch means includes a locking member that is movable between an undeflected or relaxed position and a deflected position and is resilient such that the locking member is biased toward the relaxed position by its own internal spring force. The locking member can be deflected to the deflected position by the action of the means for operating the catch means, which in the illustrated examples is a handle pivotally supported by the housing. When the pawl strikes a keeper during closing, the pawl is moved to the closed configuration. A lug projecting from the pawl is engaged by the locking member once the pawl is in the closed configuration in order to keep the pawl in the closed configuration. At this time the pawl and a portion of the housing cooperatively capture the keeper to secure the latch to the keeper. Actuating the handle by rotating it to the open position deflects the locking member out of engagement with the lug projecting from the pawl, which allows the pawl to rotate under the force of a torsion spring to the open configuration. Thus, the latch can be disengaged from the keeper and a compartment, for example, can be opened. The housing or frame of the latch is provided with a housing or receptacle for a lock barrel or lock plug. A lock barrel is supported by the receptacle in the latch frame such that the lock barrel can be selectively rotated between locked and unlocked positions by a user using an appropriate key. The lock barrel has a pin that engages a slot in one end of the locking member. Rotation of the lock barrel to the locked position rectilinearly moves the locking member to a position where the locking member can no longer be engaged by the handle such that rotating the handle to the open position no longer deflects the locking member out of engagement with the lug projecting from the pawl. Thus, the lock barrel can be used to selectively lock the rotary pawl latch against opening.

DETAILED DESCRIPTION OF THE INVENTION

Figure 1:
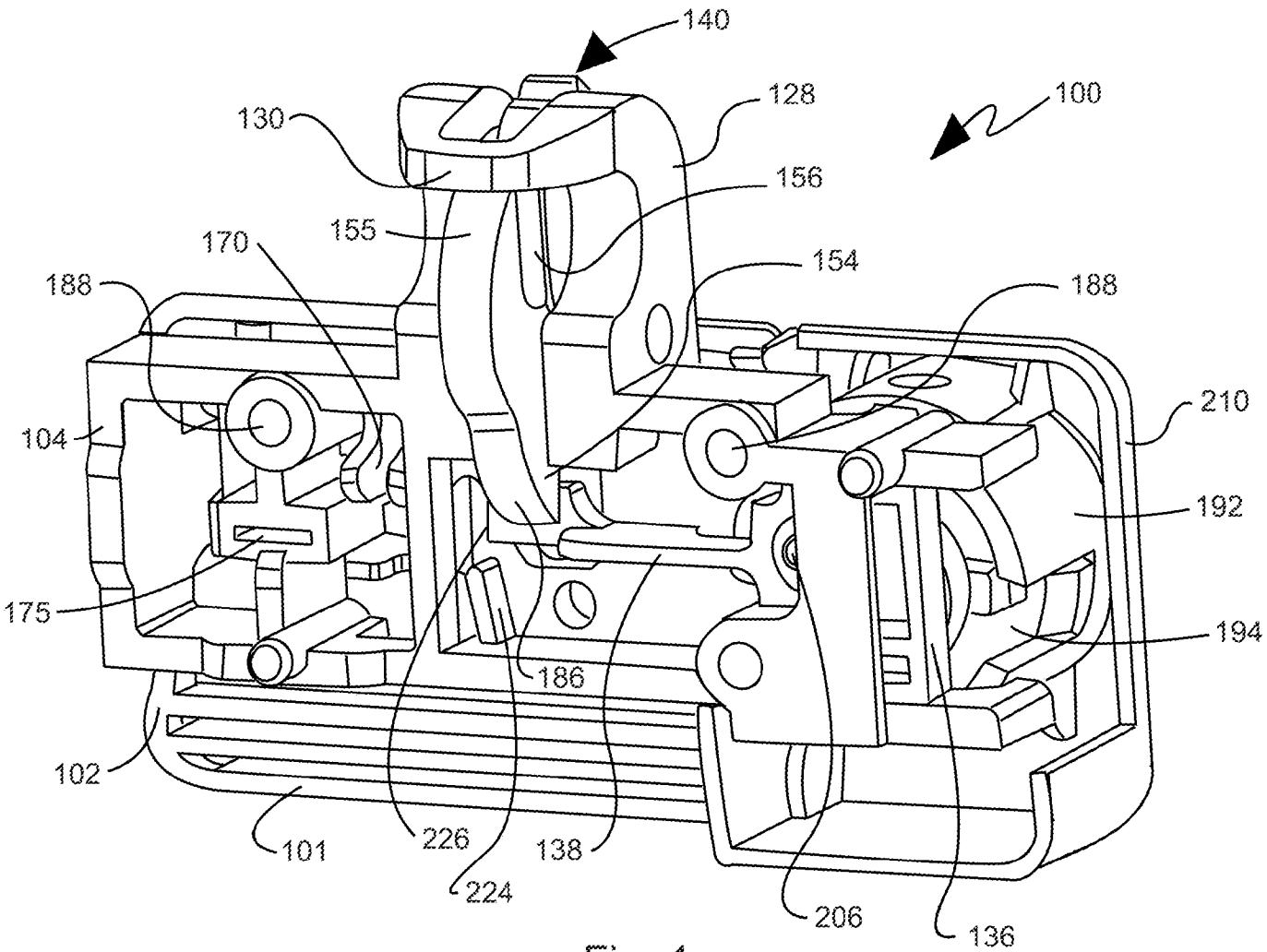
FIG. 1 is an isometric view of the rotary pawl latch according to the present invention shown from the rear, with the lock plug installed, and with the locking member in the unlocked position.
Figure 2:
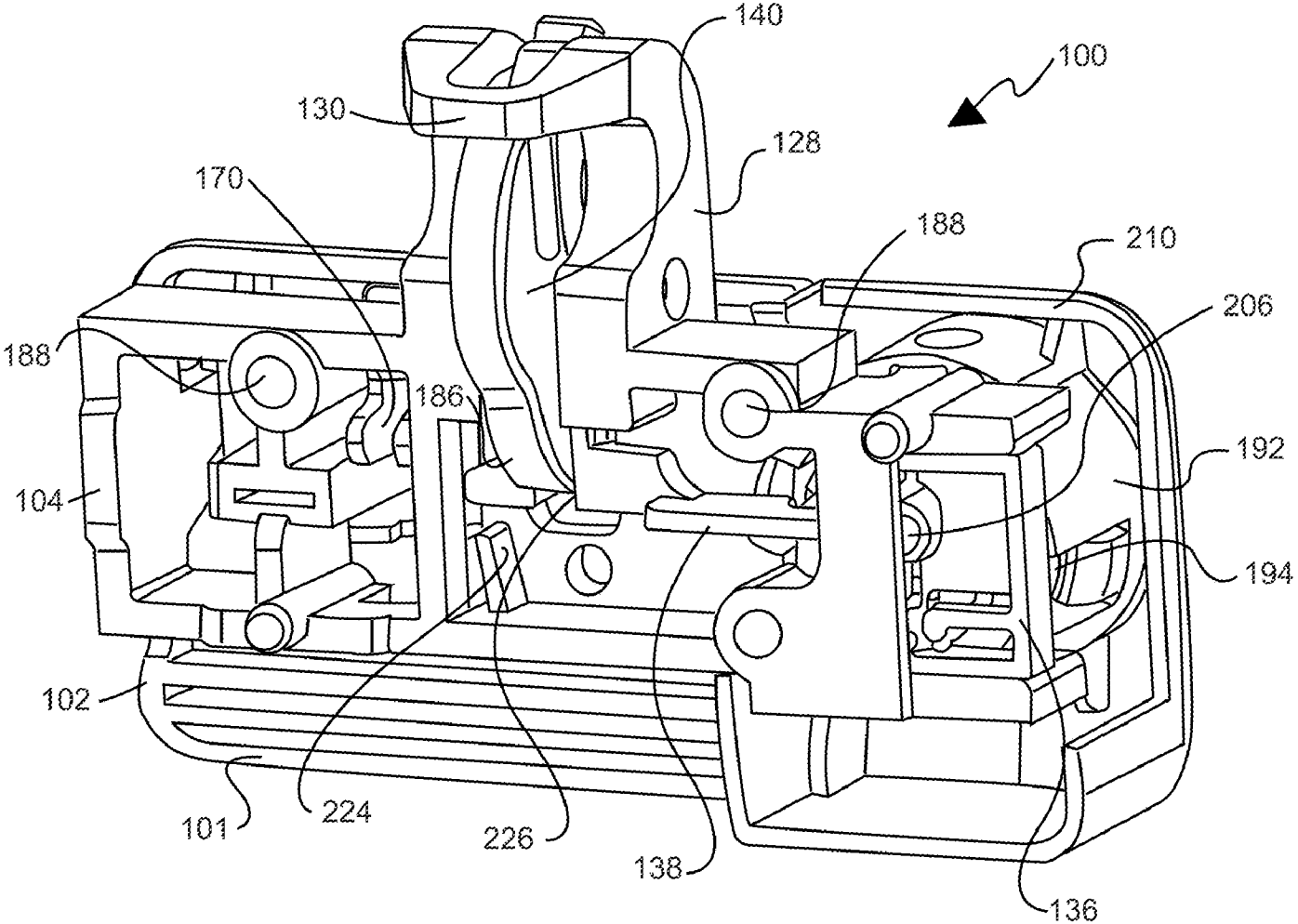
FIG. 2 is an isometric view of the rotary pawl latch according to the present invention shown from the rear, with the lock plug installed, and with the locking member in the locked position.
Figure 3:
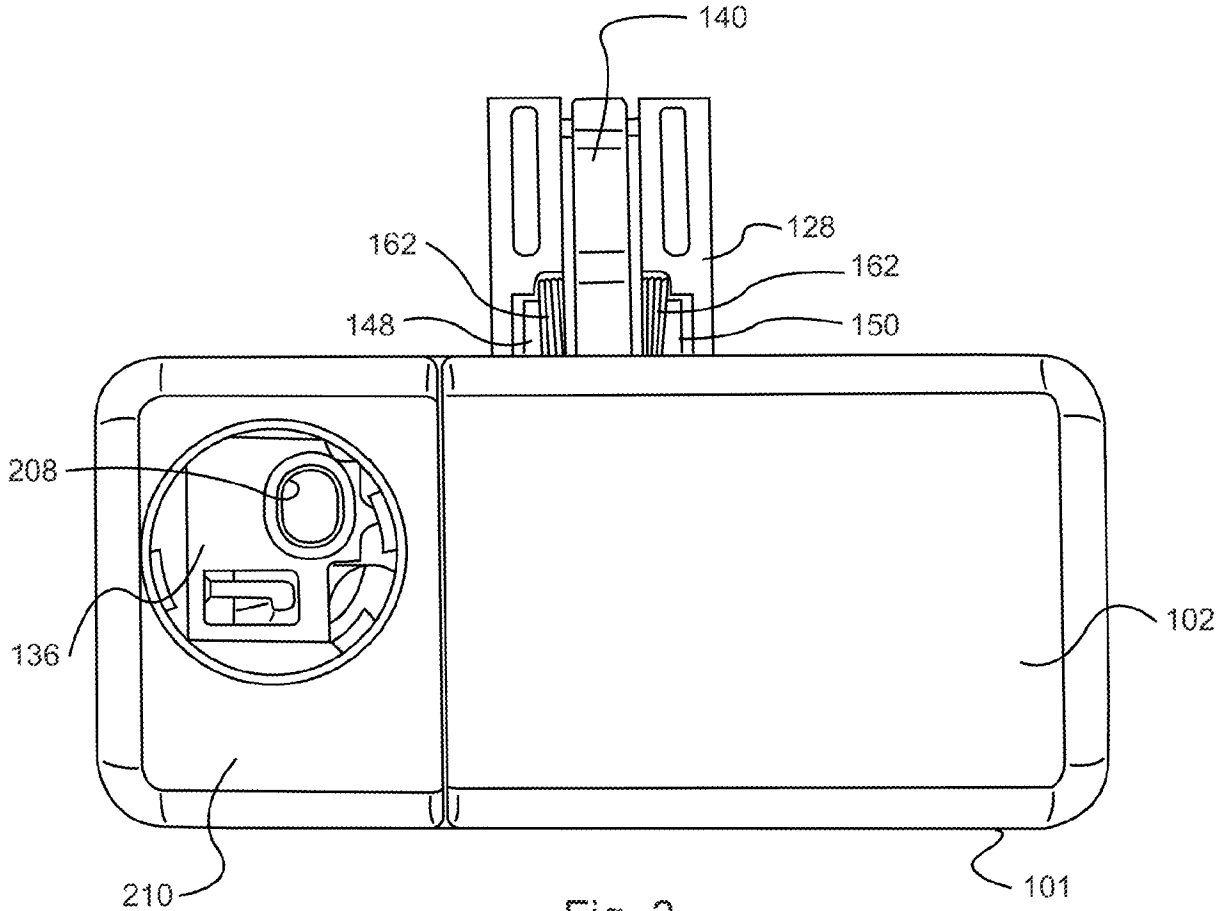
FIG. 3 is a front elevational view of the rotary pawl latch according to the present invention shown with the lock plug removed and with the handle in the closed position.
Figure 4:
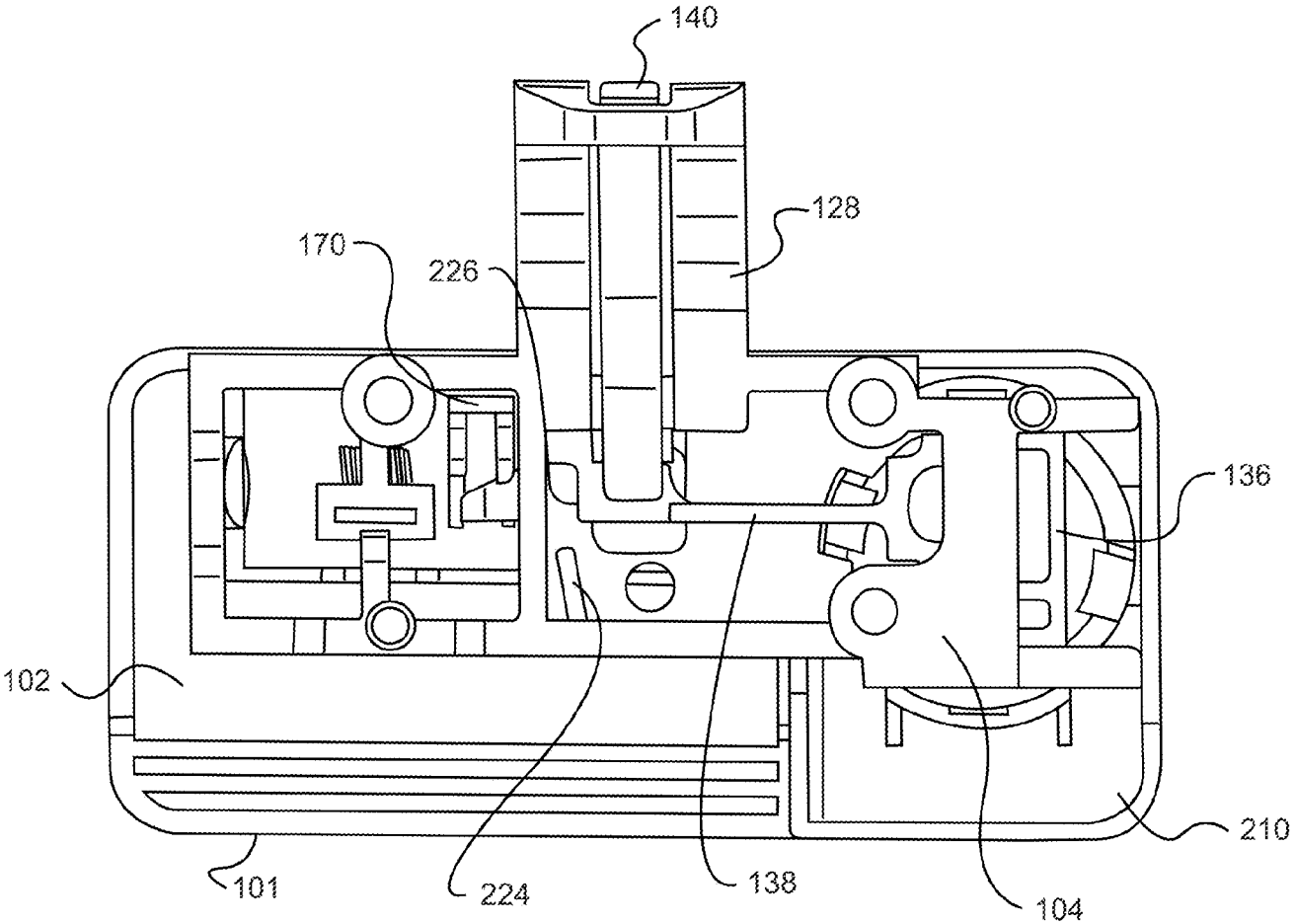
FIG. 4 is a rear elevational view of the rotary pawl latch according to the present invention shown with the lock plug removed and with the locking member in the unlocked position.
Figure 5:
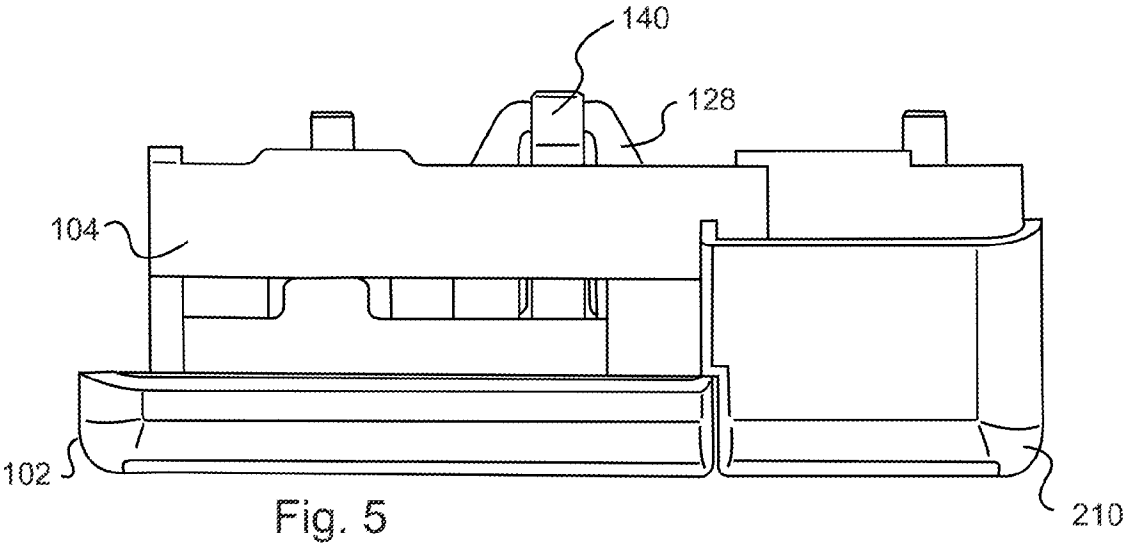
FIG. 5 is a bottom view of the rotary pawl latch according to the present invention.
Figure 6:
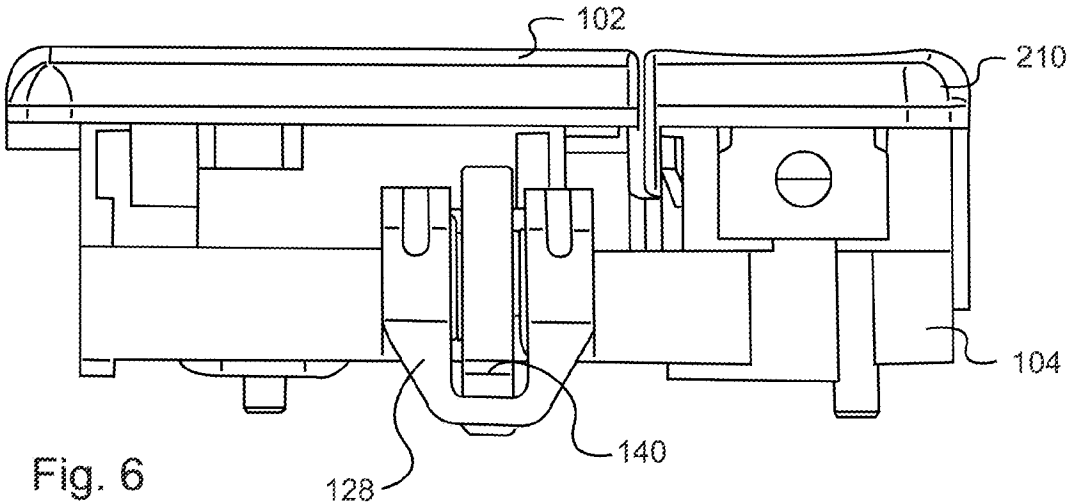
FIG. 6 is a top view of the rotary pawl latch according to the present invention.
Figure 8:
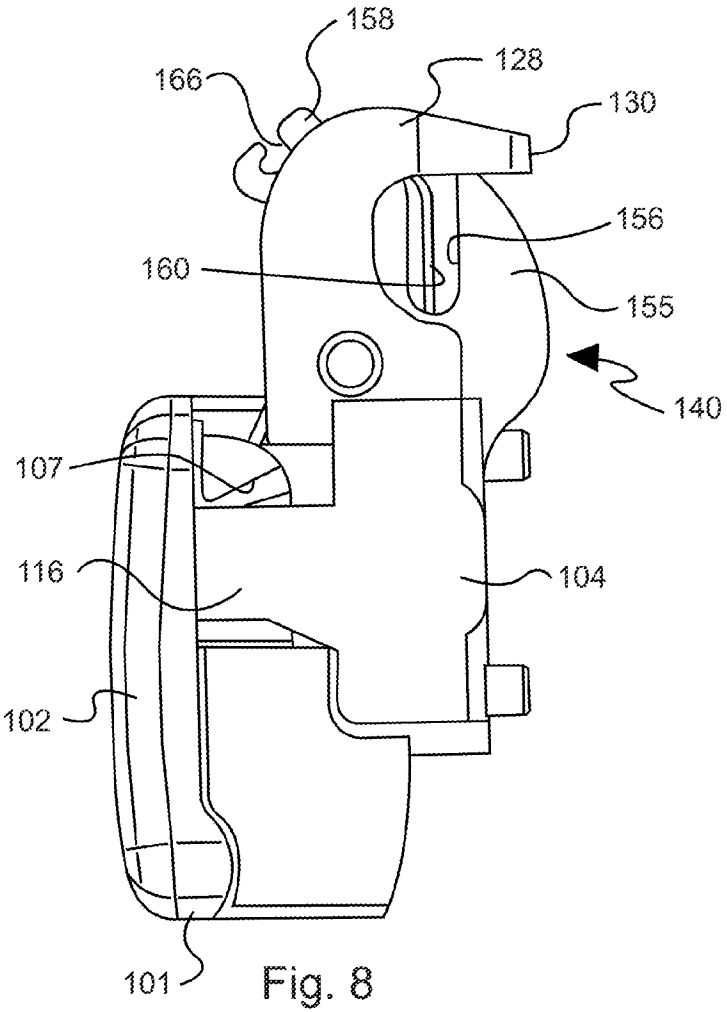
FIG. 8 is a left side view of the rotary pawl latch according to the present invention.
Figure 7:
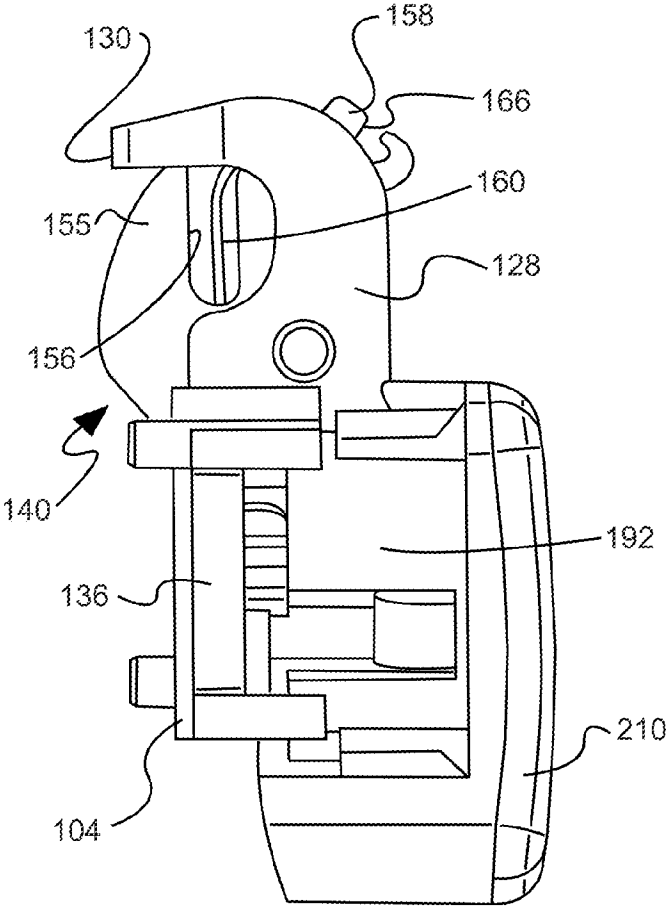
FIG. 7 is a right side view of the rotary pawl latch according to the present invention.
Figure 9:
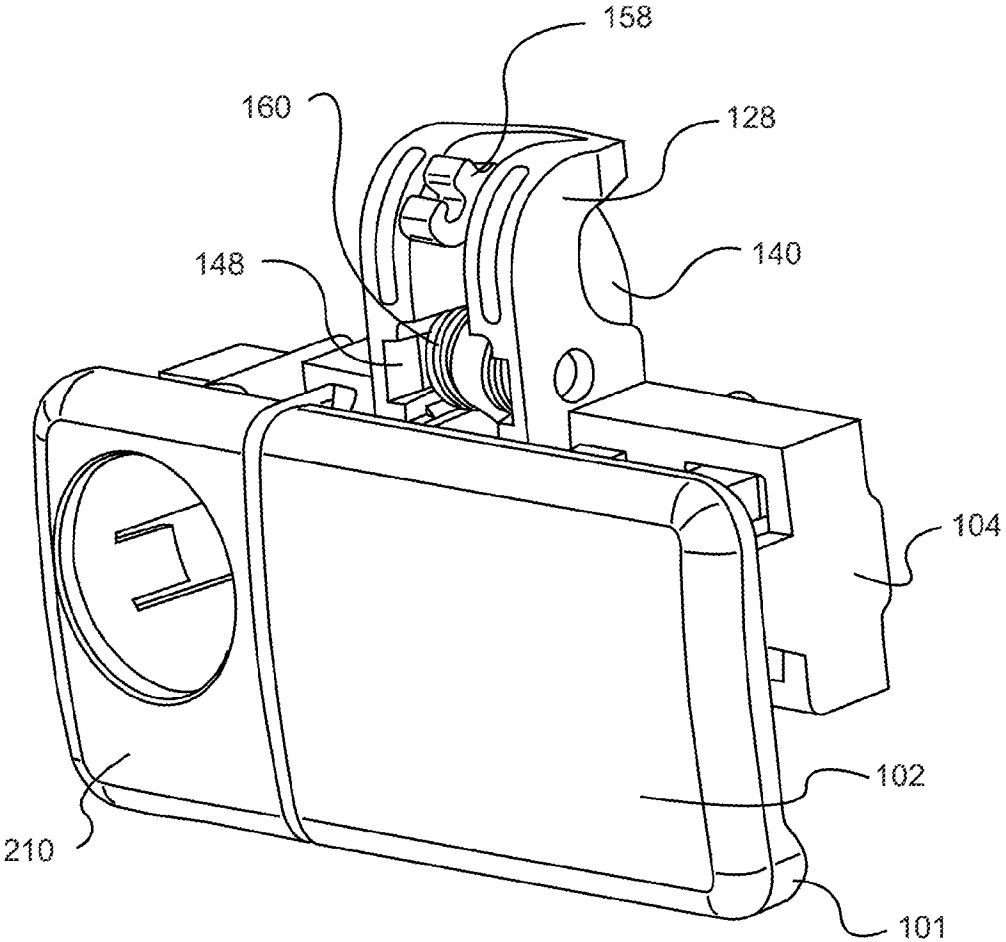
FIG. 9 is a front isometric view of the rotary pawl latch according to the present invention shown with the lock plug removed and with the handle in the closed position.
Figure 10:
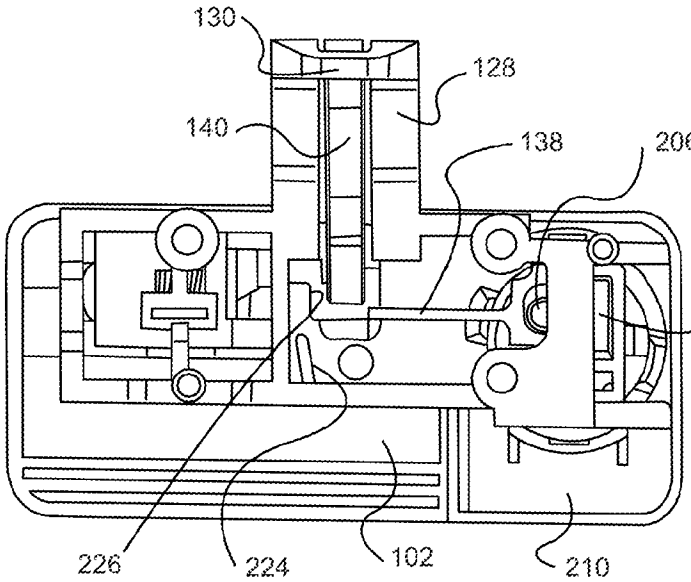
FIG. 10 is a rear elevational view of the rotary pawl latch according to the present invention shown with the lock plug installed, with the locking member in the unlocked and undeflected position, with the handle in the closed position, and with the pawl in the latched position.
Figure 11:
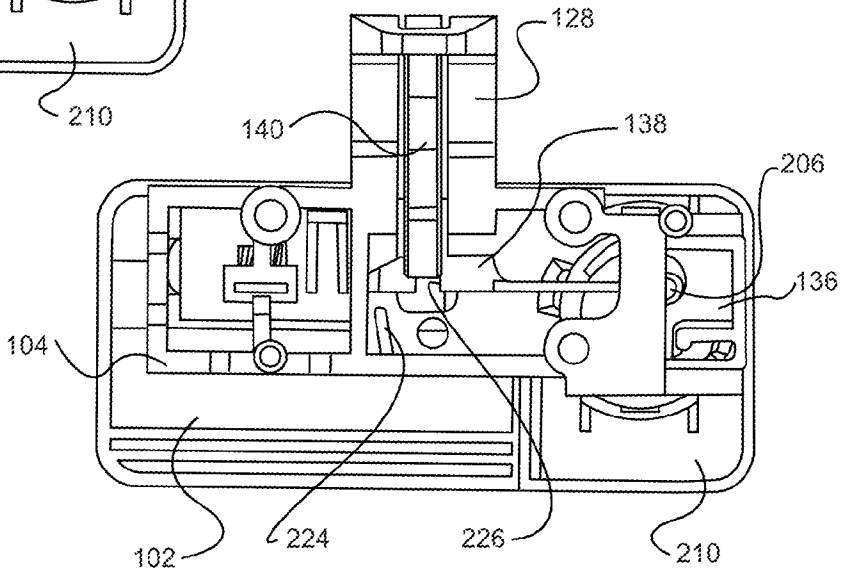
FIG. 11 is a rear elevational view of the rotary pawl latch according to the present invention shown with the lock plug installed, with the locking member in the locked and undeflected position, with the handle in the closed position, and with the pawl in the latched position.
Figure 12:
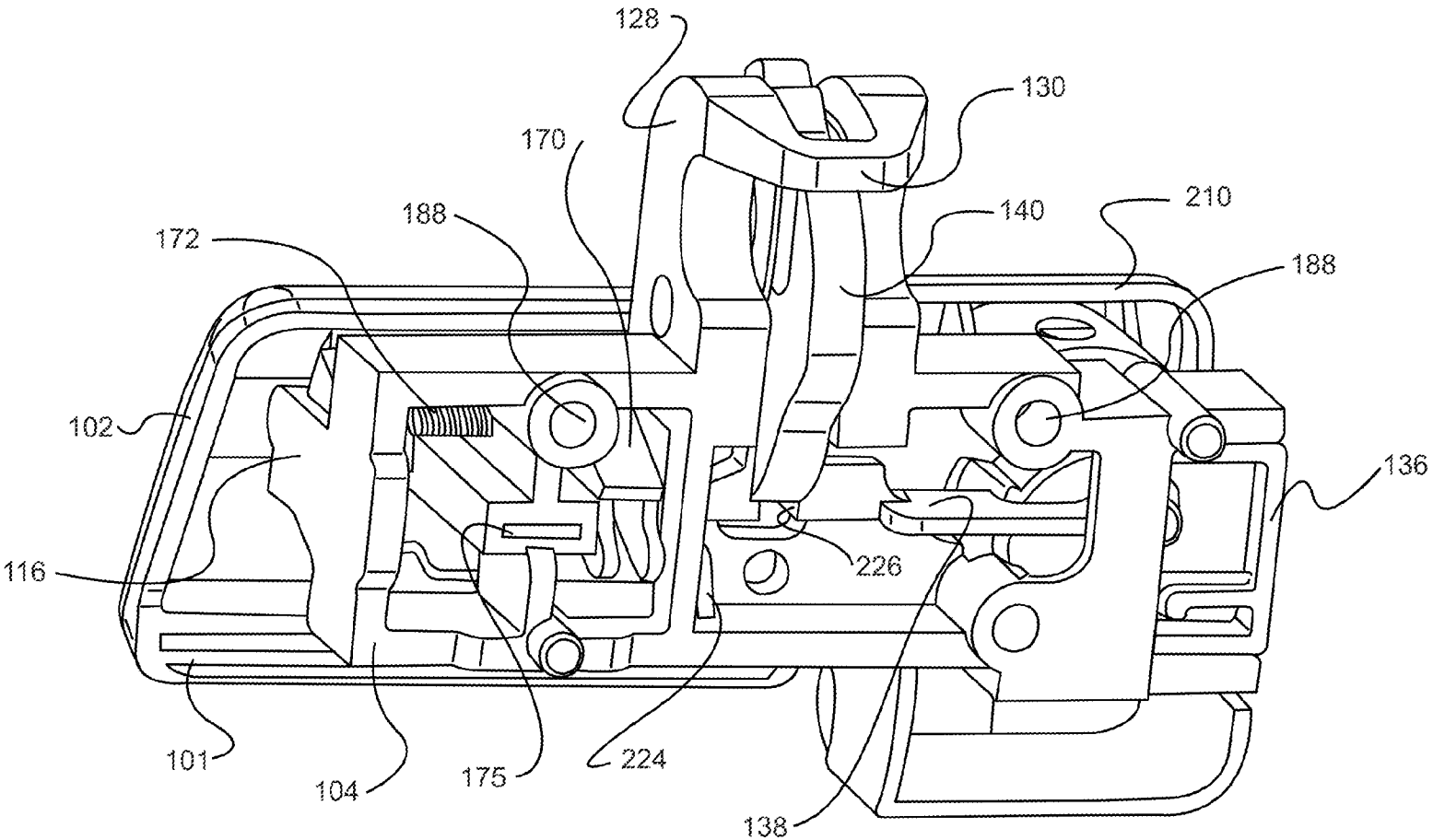
FIG. 12 is an isometric view of the rotary pawl latch according to the present invention shown from the rear, with the lock plug installed, with the locking member in the locked position, with the handle pivotally moved to the open position, and with the pawl in the latched position.
Figure 13:
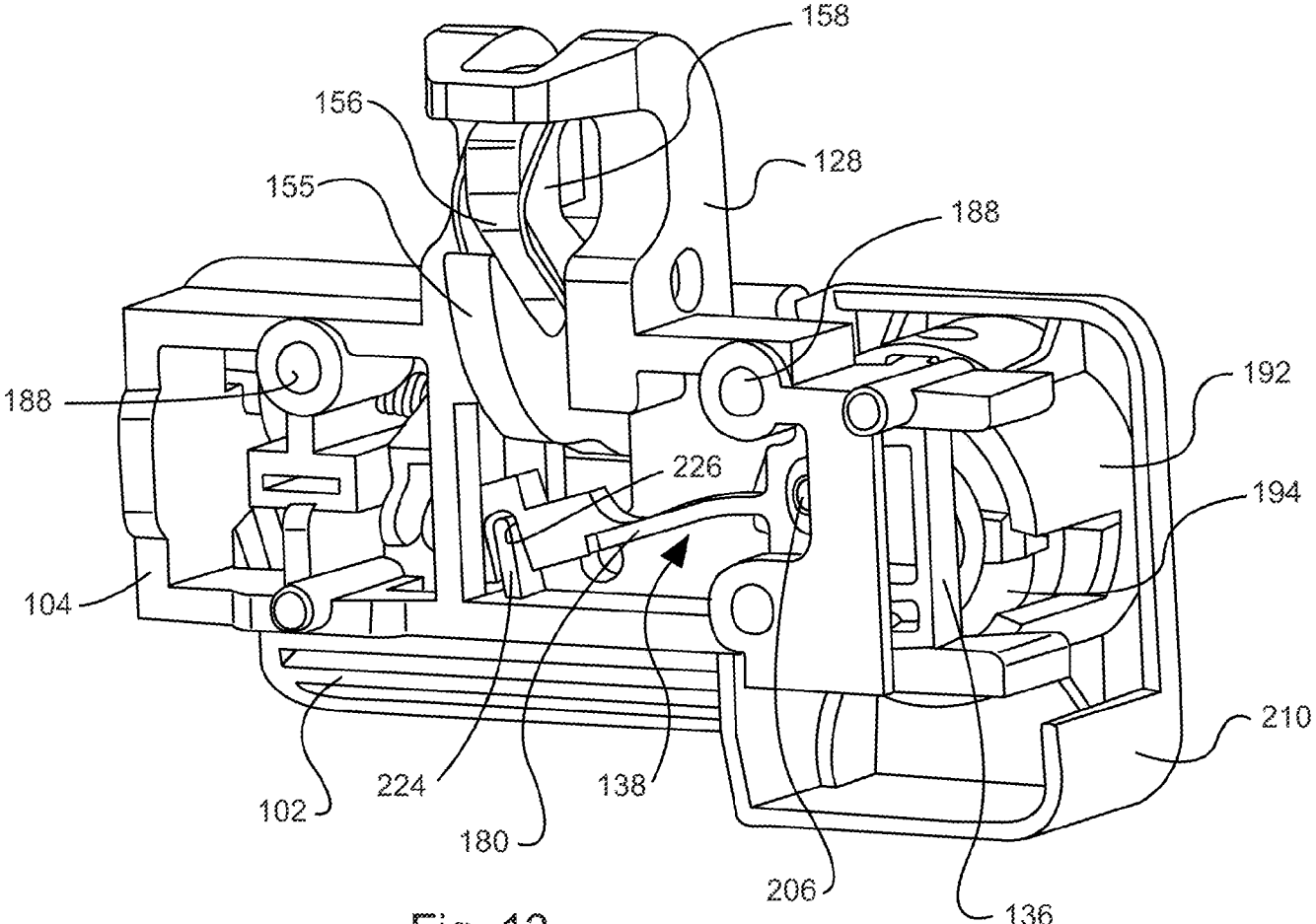
FIG. 13 is an isometric view of the rotary pawl latch according to the present invention shown from the rear, with the lock plug installed, with the locking member in the unlocked and deflected position, with the handle pivotally moved to the open position, and with the pawl rotated to the unlatched position.
Figure 14:
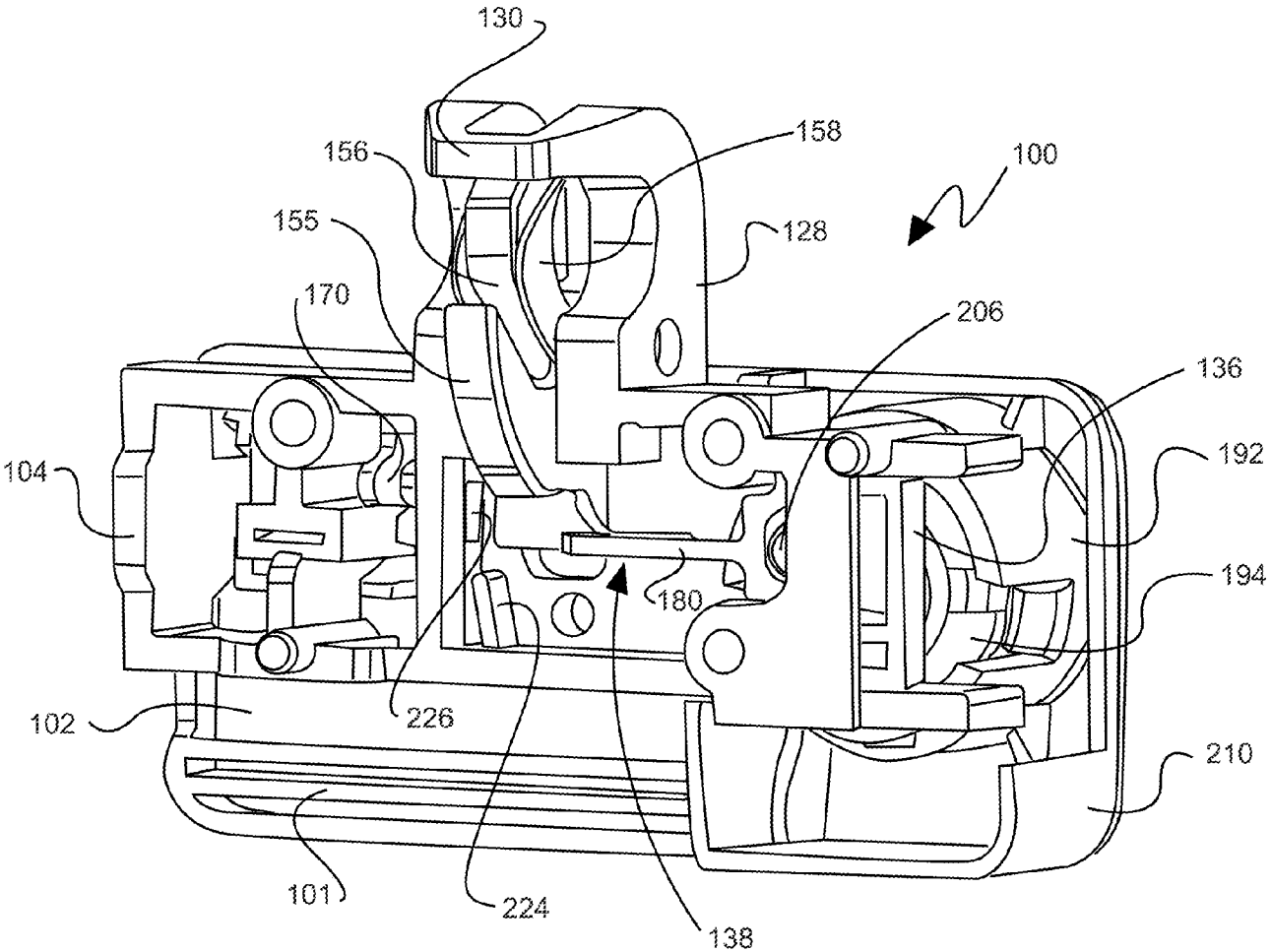
FIG. 14 is an isometric view of the rotary pawl latch according to the present invention shown from the rear, with the lock plug installed, with the locking member in the unlocked and undeflected position, with the handle in the closed position, and with the pawl rotated to the unlatched position.
Figures 15, 16:
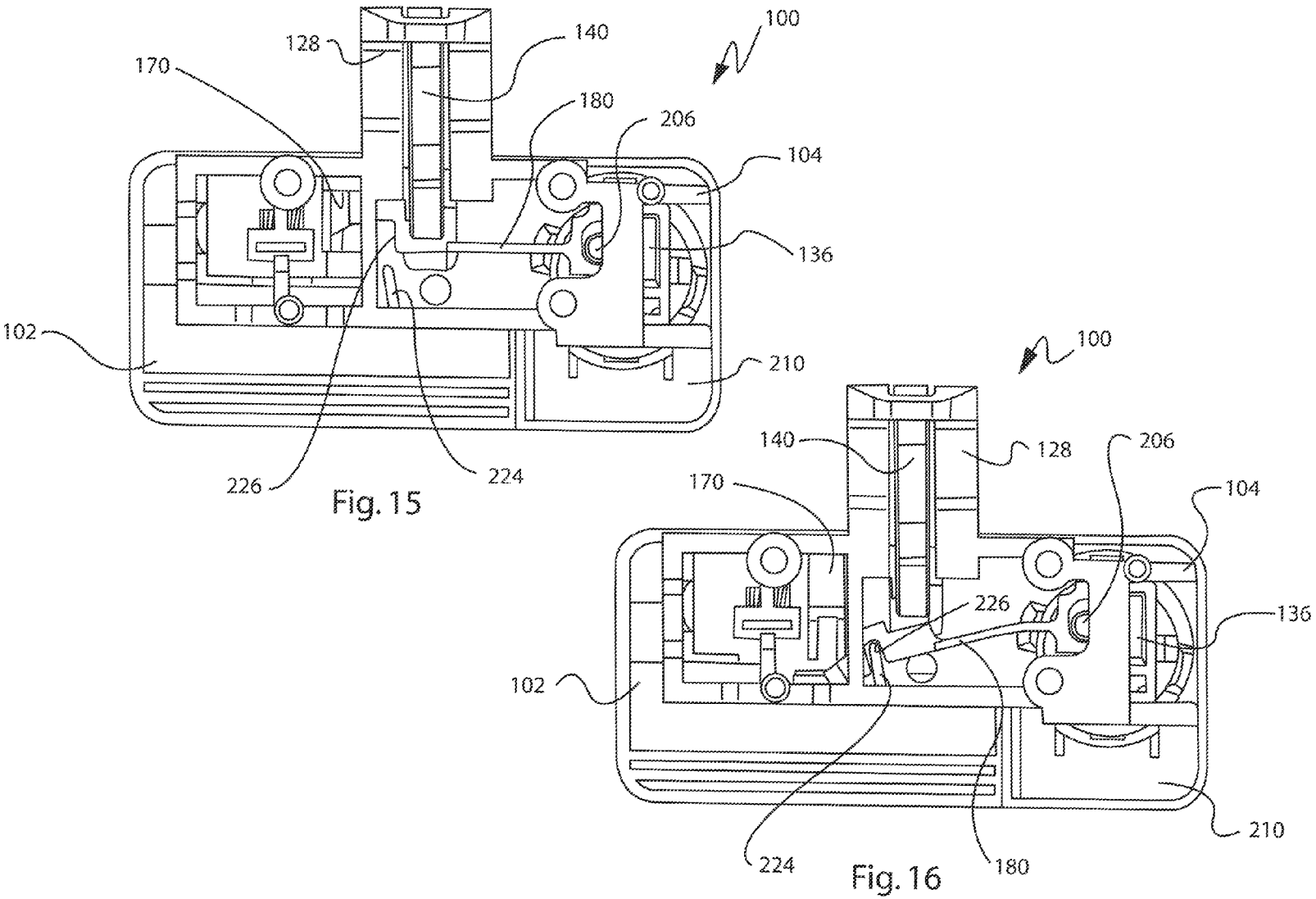
FIG. 15 is a rear elevational view of the rotary pawl latch according to the present invention shown with the lock plug installed, with the locking member in the unlocked and undeflected position, with the handle in the closed position, and with the pawl in the latched position.
FIG. 16 is a rear elevational view of the rotary pawl latch according to the present invention shown with the lock plug installed, with the locking member in the unlocked and deflected position, with the handle in the open position, and with the pawl rotated to the unlatched position.
Figure 17:
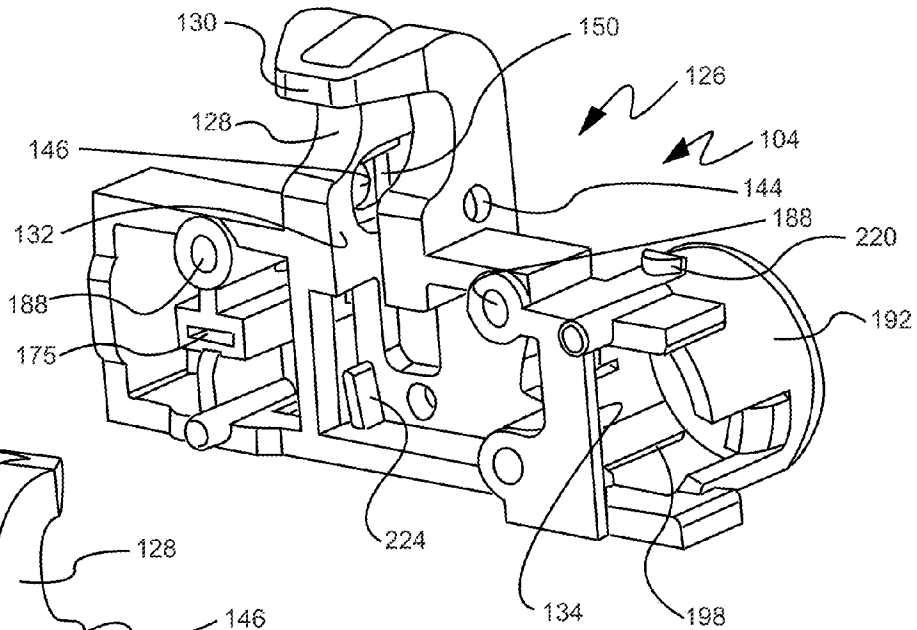
FIG. 17 is a rear isometric view of the housing or frame of the rotary pawl latch according to the present invention.
Figure 18:
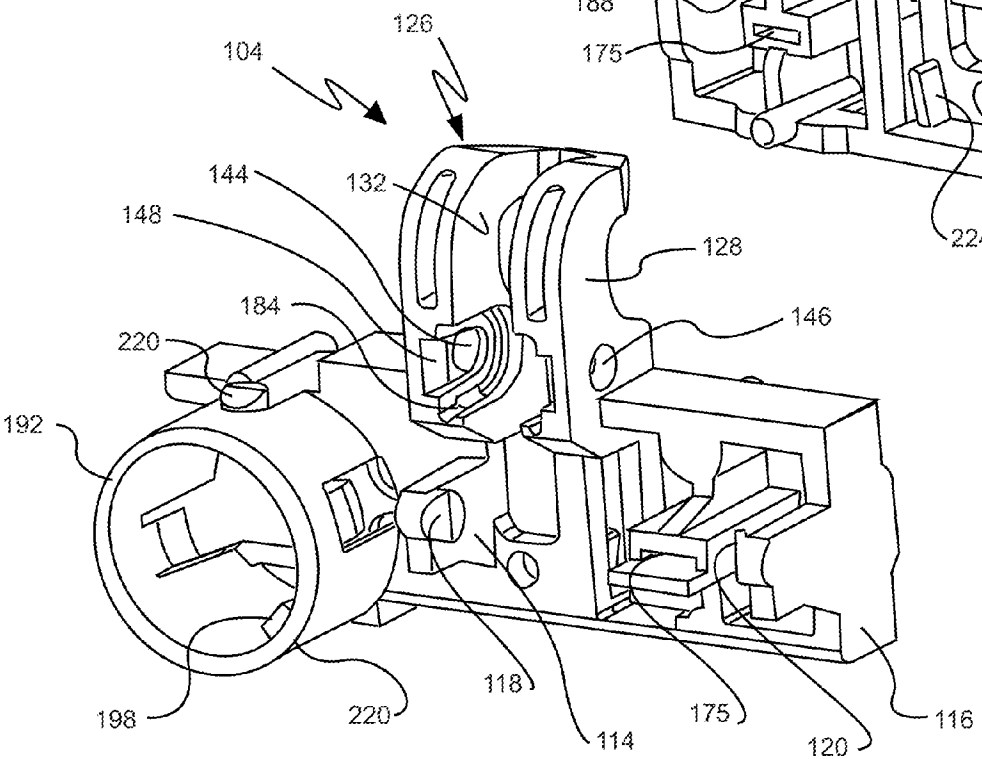
FIG. 18 is a front isometric view of the housing or frame of the rotary pawl latch according to the present invention.
Figure 19:
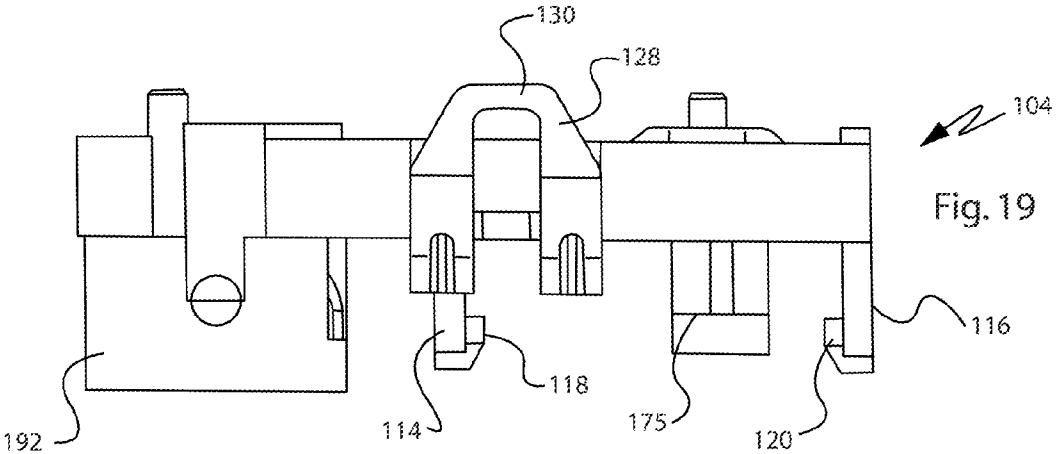
FIG. 19 is a top view of the housing or frame of the rotary pawl latch according to the present invention.
Figure 21:
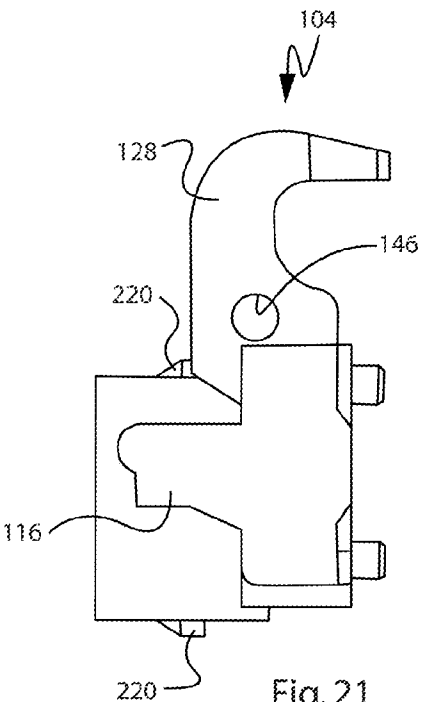
FIG. 21 is a left side view of the housing or frame of the rotary pawl latch according to the present invention.
Figure 20:
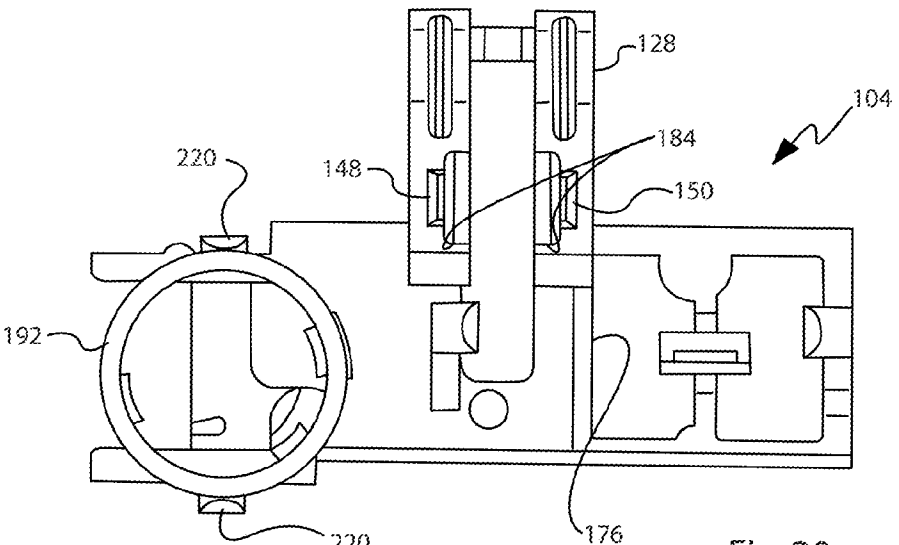
FIG. 20 is a front view of the housing or frame of the rotary pawl latch according to the present invention.
Figures 22, 23, 24:
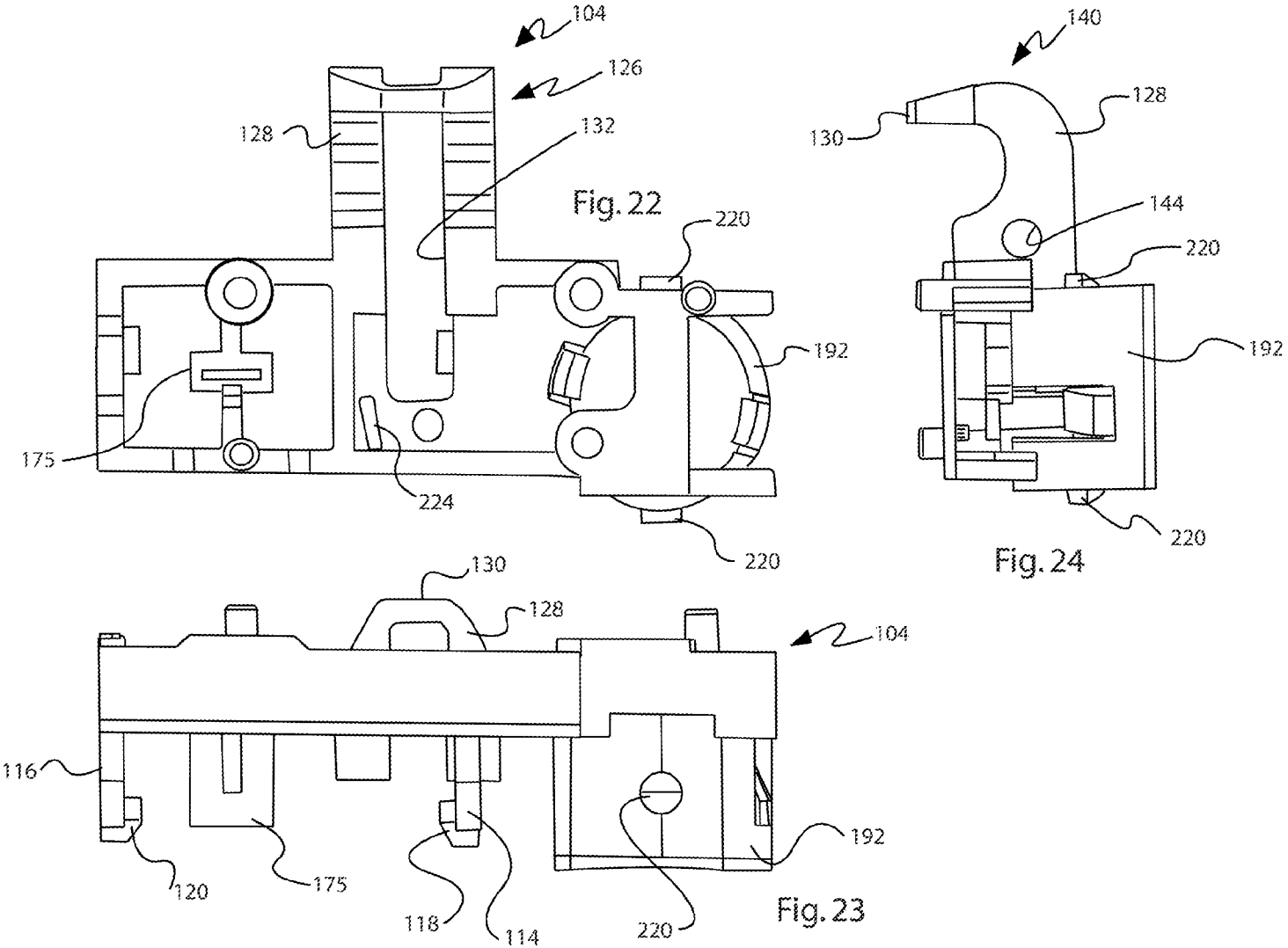
FIG. 22 is a rear view of the housing or frame of the rotary pawl latch according to the present invention.
FIG. 23 is a bottom view of the housing or frame of the rotary pawl latch according to the present invention.
FIG. 24 is a right side view of the housing or frame of the rotary pawl latch according to the present invention.
Figure 26:
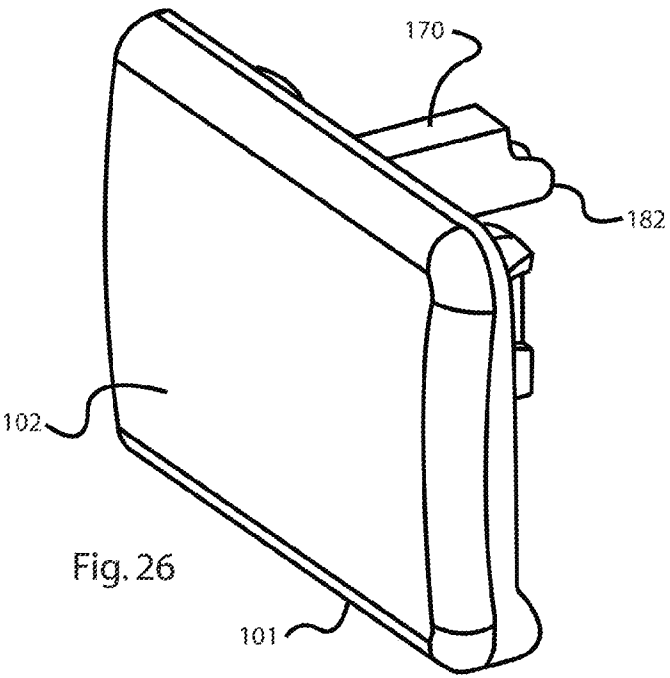
FIG. 26 is a front isometric view of the handle of the rotary pawl latch according to the present invention.
Figure 25:
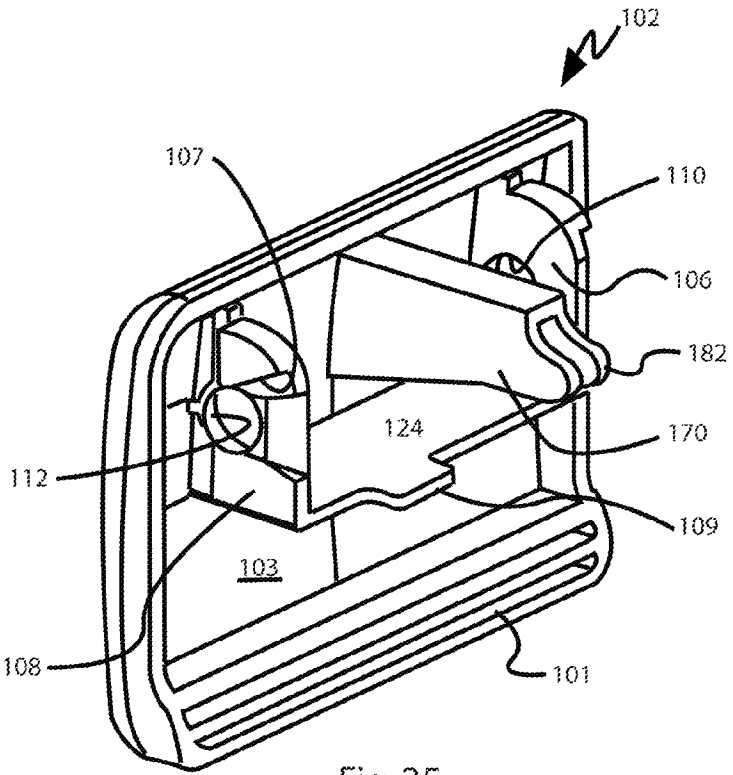
FIG. 25 is a rear isometric view of the handle of the rotary pawl latch according to the present invention.
Figure 27:
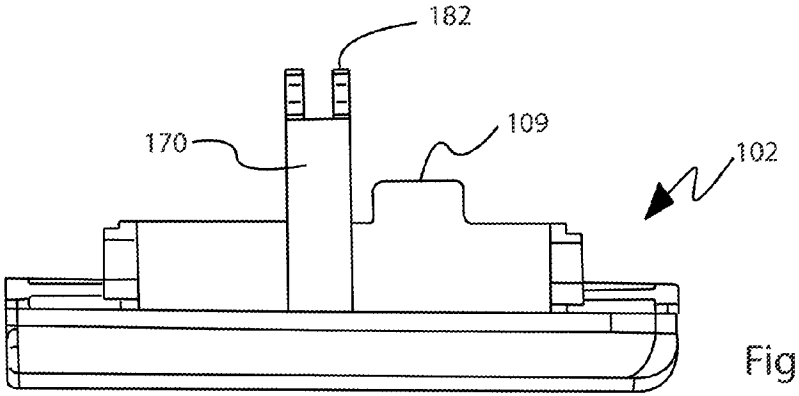
FIG. 27 is a top view of the handle of the rotary pawl latch according to the present invention.
Figure 28:
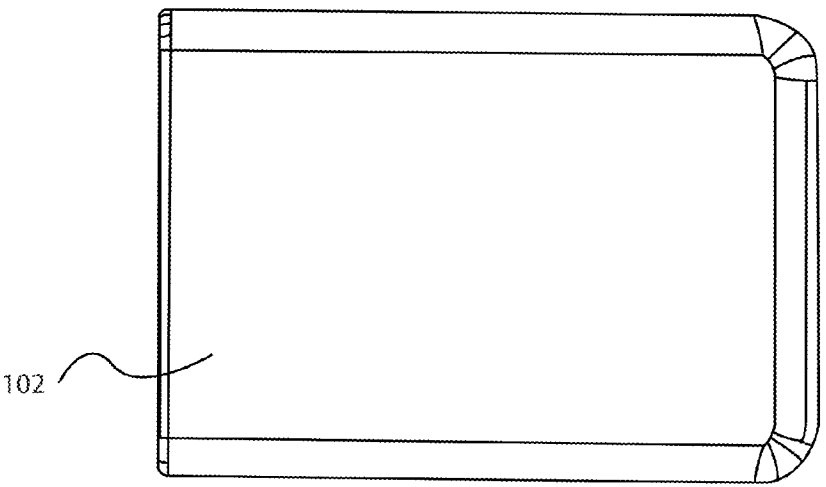
FIG. 28 is a front view of the handle of the rotary pawl latch according to the present invention.
Figure 29:
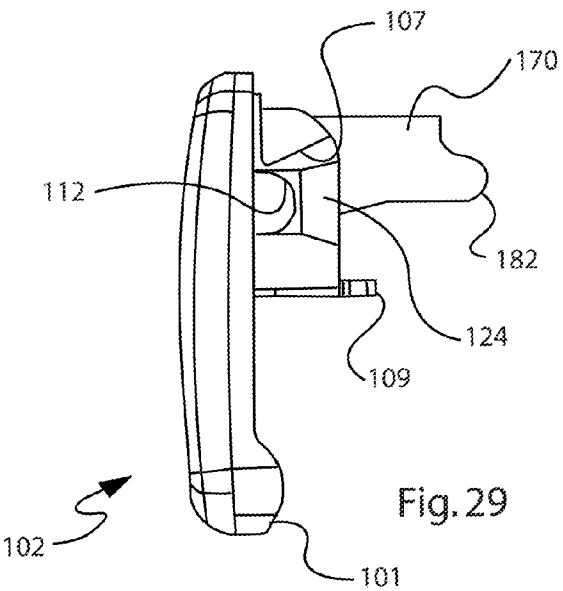
FIG. 29 is a left side view of the handle of the rotary pawl latch according to the present invention.
Figures 30, 31, 32:
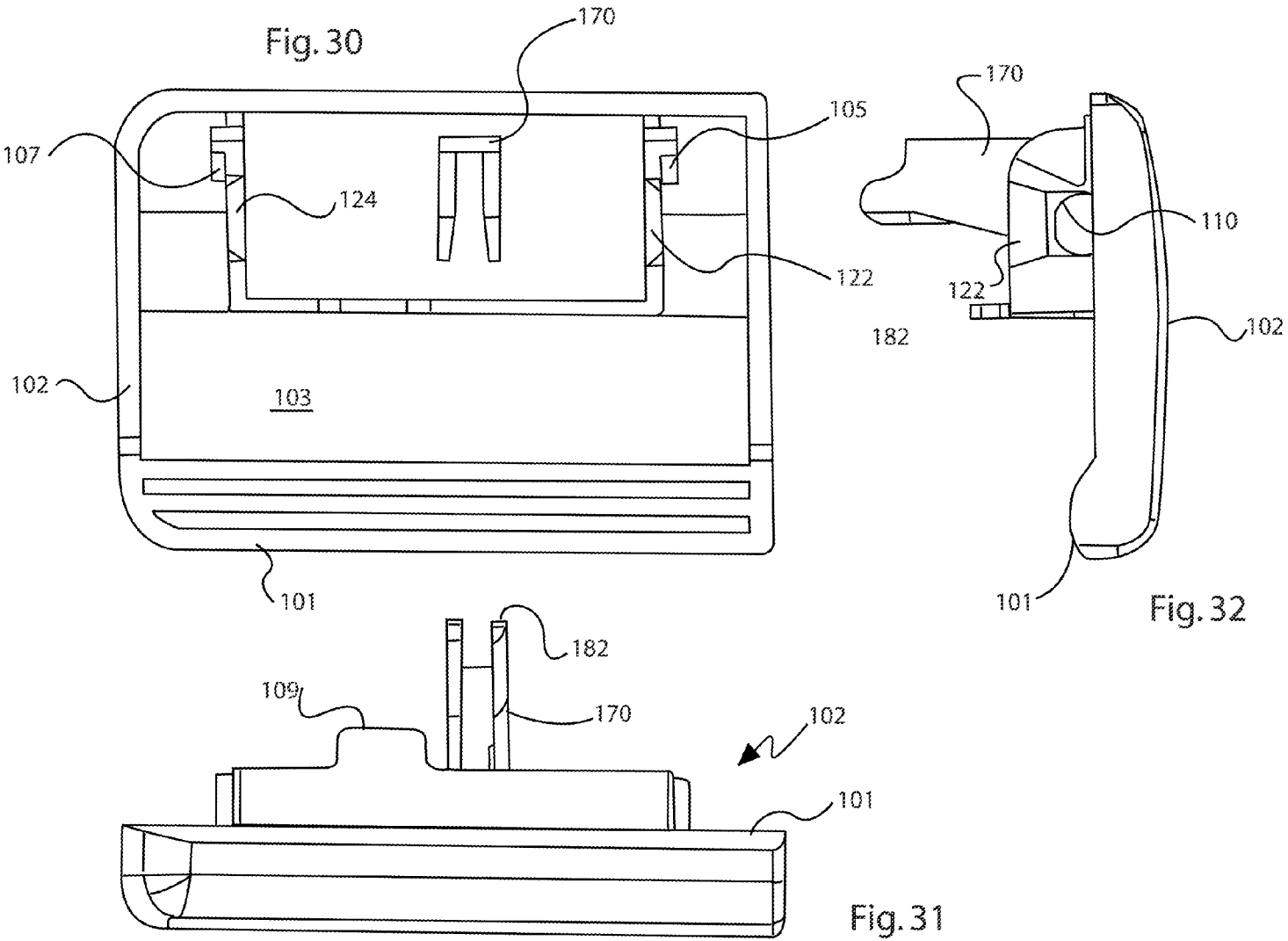
FIG. 30 is a rear view of the handle of the rotary pawl latch according to the present invention.
FIG. 31 is a bottom view of the handle of the rotary pawl latch according to the present invention.
FIG. 32 is a right side view of the handle of the rotary pawl latch according to the present invention.
Figure 34:
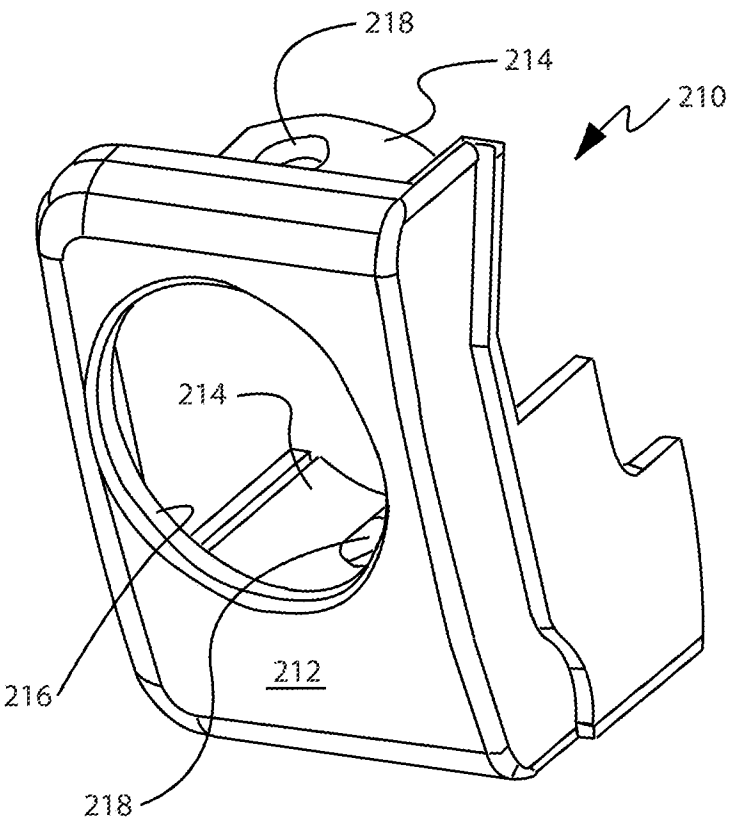
FIG. 34 is a front isometric view of the lock plug receptacle cover of the rotary pawl latch according to the present invention.
Figure 33:
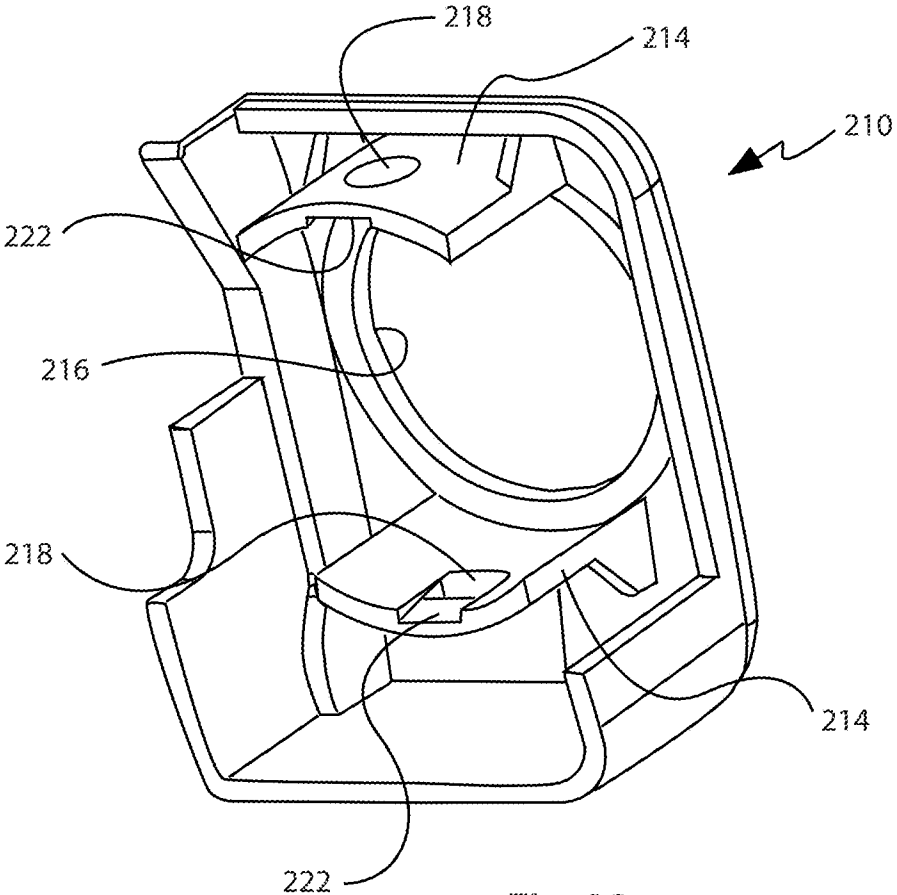
FIG. 33 is a rear isometric view of the lock plug receptacle cover of the rotary pawl latch according to the present invention.
Figure 35:
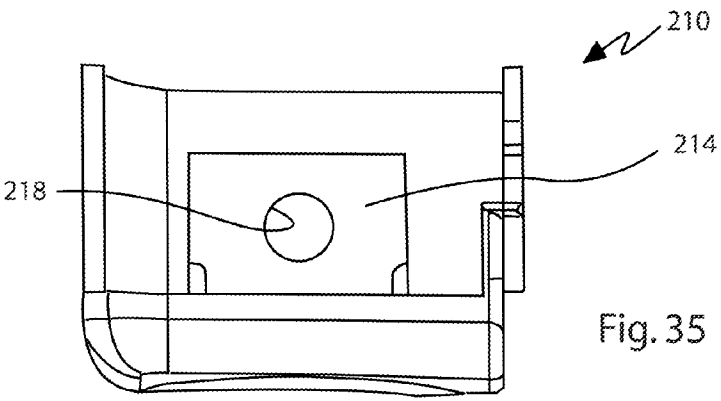
FIG. 35 is a top view of the lock plug receptacle cover of the rotary pawl latch according to the present invention.
Figure 36:
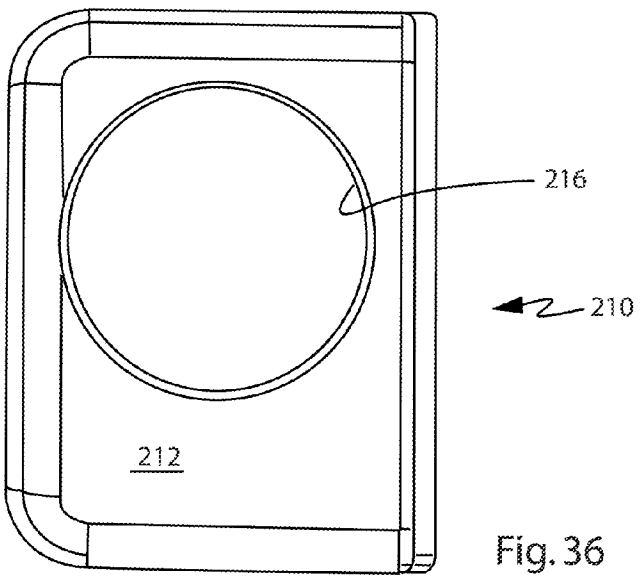
FIG. 36 is a front view of the lock plug receptacle cover of the rotary pawl latch according to the present invention.
Figure 37:
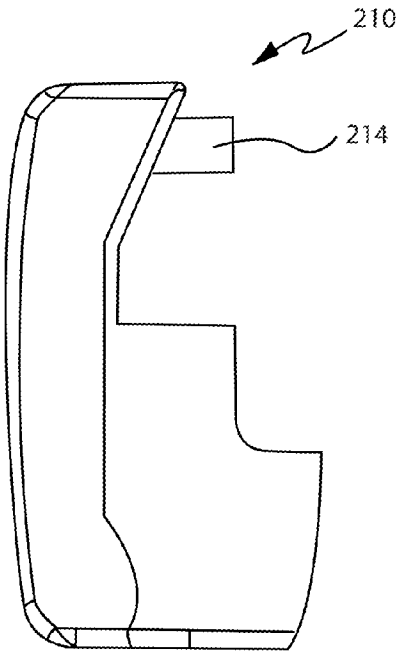
FIG. 37 is a left side view of the lock plug receptacle cover of the rotary pawl latch according to the present invention.
Figure 40:
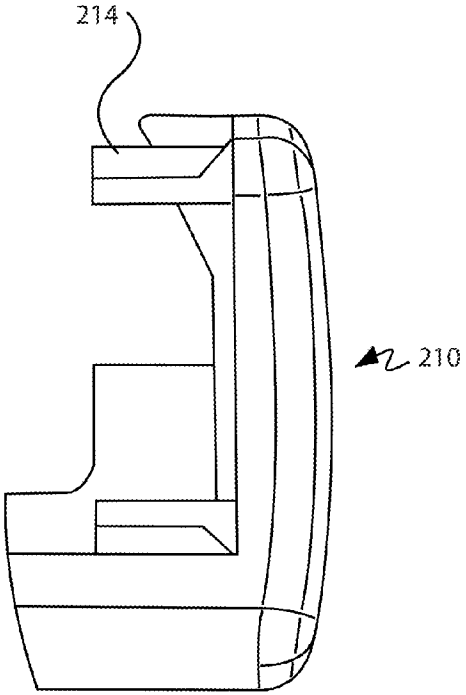
FIG. 40 is a right side view of the lock plug receptacle cover of the rotary pawl latch according to the present invention.
Figure 38:
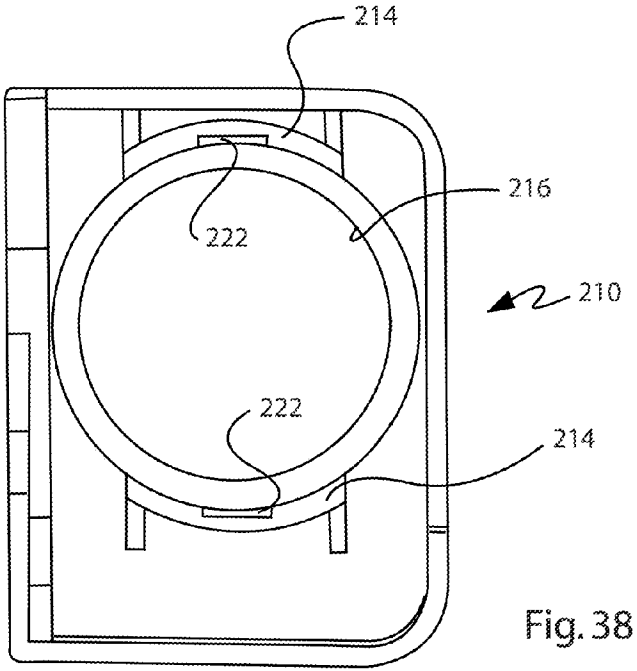
FIG. 38 is a rear view of the lock plug receptacle cover of the rotary pawl latch according to the present invention.
Figure 39:
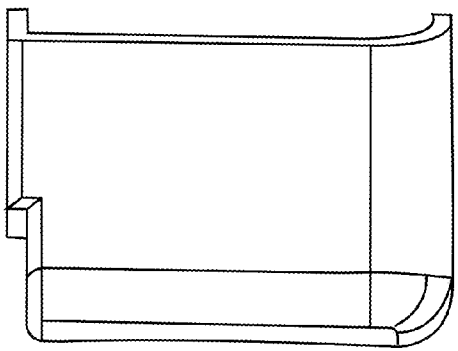
FIG. 39 is a bottom view of the lock plug receptacle cover of the rotary pawl latch according to the present invention.
Figure 41:
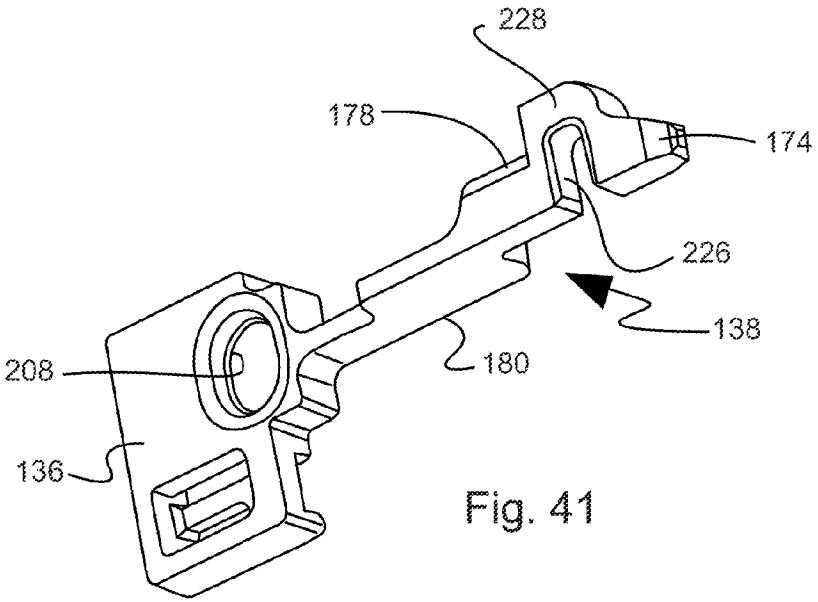
FIG. 41 is a front isometric view of the locking member of the rotary pawl latch according to the present invention.
Figure 42:
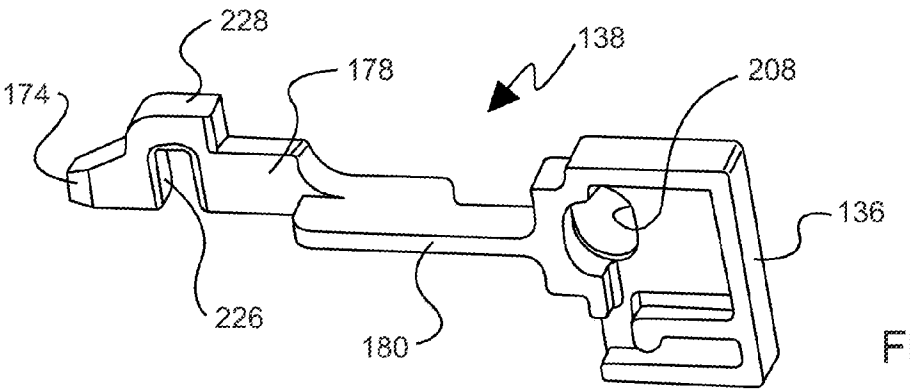
FIG. 42 is a rear isometric view of the locking member of the rotary pawl latch according to the present invention.
Figure 48:
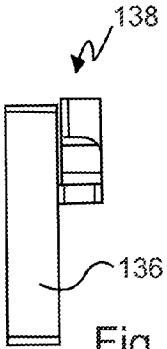
FIG. 48 is a right side view of the locking member of the rotary pawl latch according to the present invention.
Figure 43:
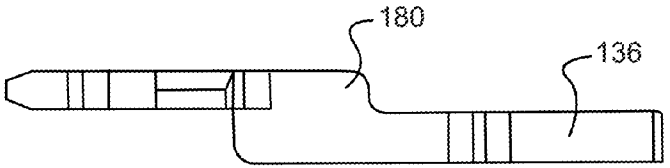
FIG. 43 is a top view of the locking member of the rotary pawl latch according to the present invention.
Figure 44:
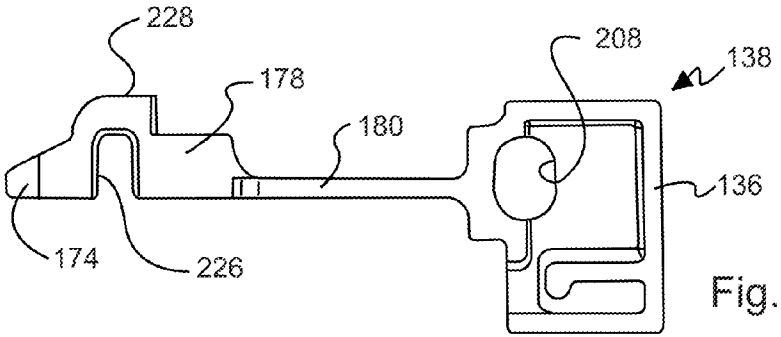
FIG. 44 is a rear view of the locking member of the rotary pawl latch according to the present invention.
Figure 45:
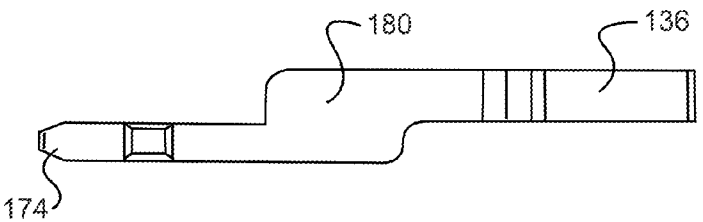
FIG. 45 is a bottom view of the locking member of the rotary pawl latch according to the present invention.
Figure 46:
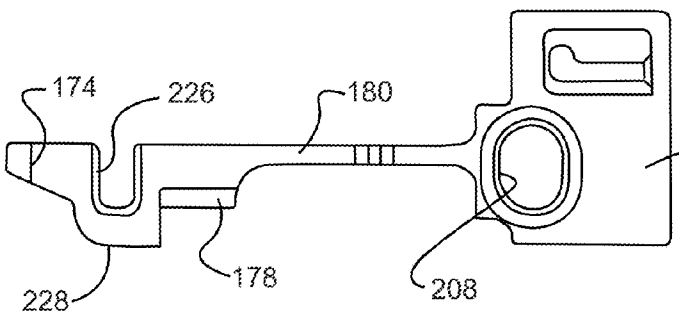
FIG. 46 is a front view of the locking member of the rotary pawl latch according to the present invention.
Figure 47:
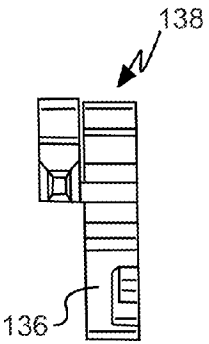
FIG. 47 is a left side view of the locking member of the rotary pawl latch according to the present invention.
Figure 49:
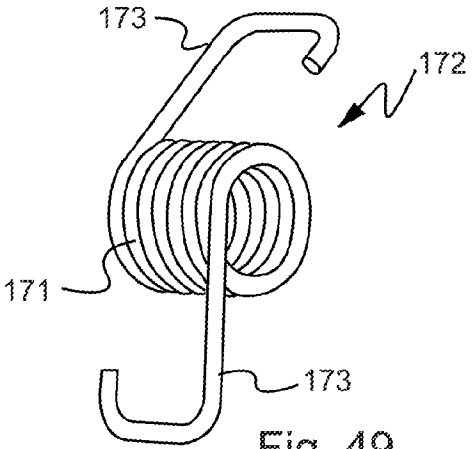
FIGS. 49-55 are views of the handle torsion spring of the rotary pawl latch according to the present invention.
Figure 50:
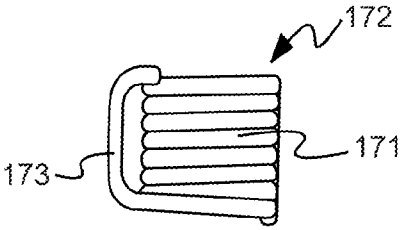
Figure 51:
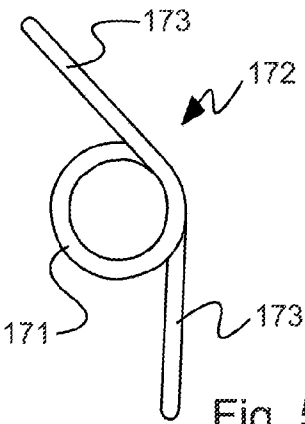
Figure 52:
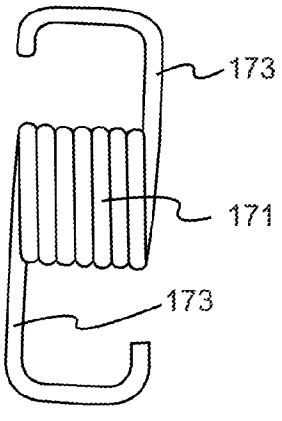
Figure 53:
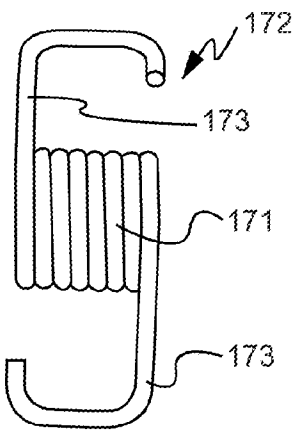
Figure 54:
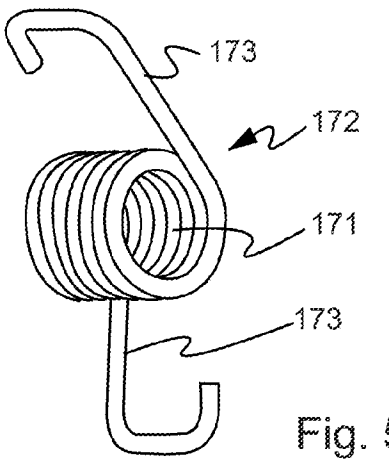
Figure 55:
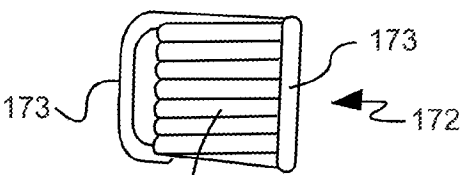
Figure 56:
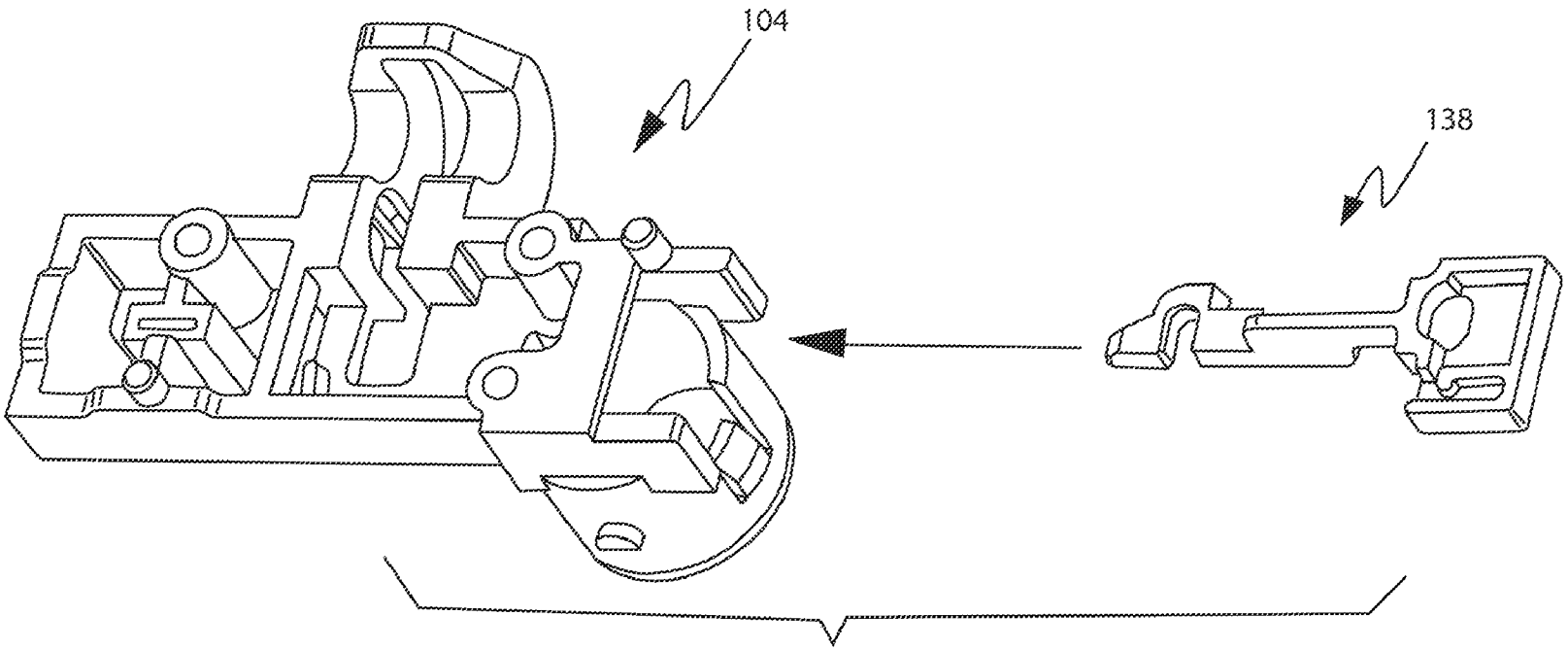
FIGS. 56-58 illustrate the sequence of assembly of the locking member to the frame or housing of the rotary pawl latch according to the present invention.
Figure 58:
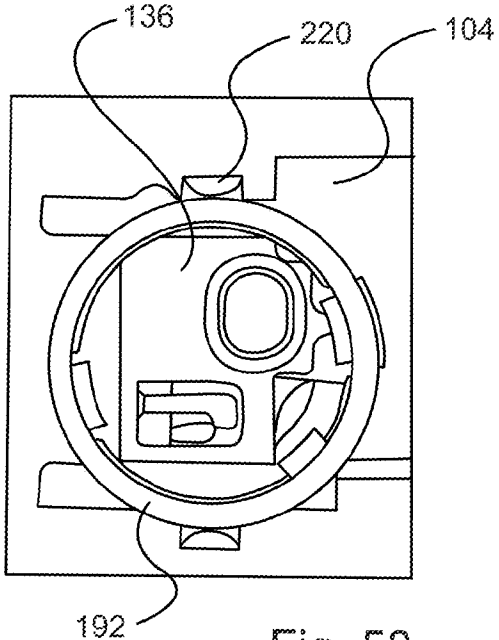
Figure 57:
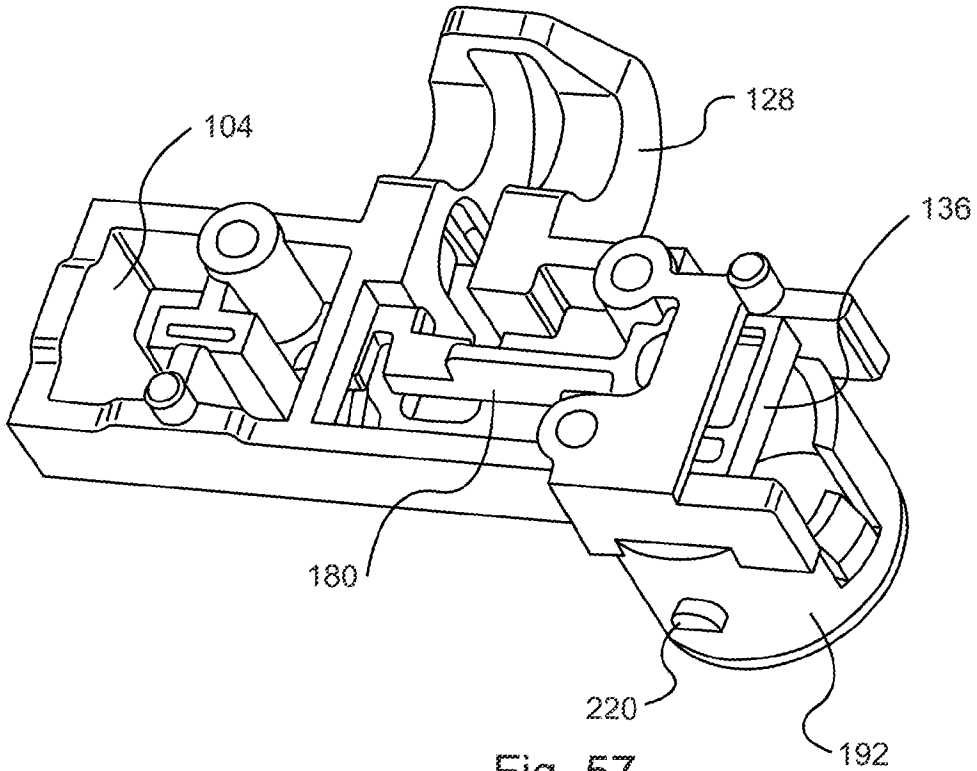
Figure 59:
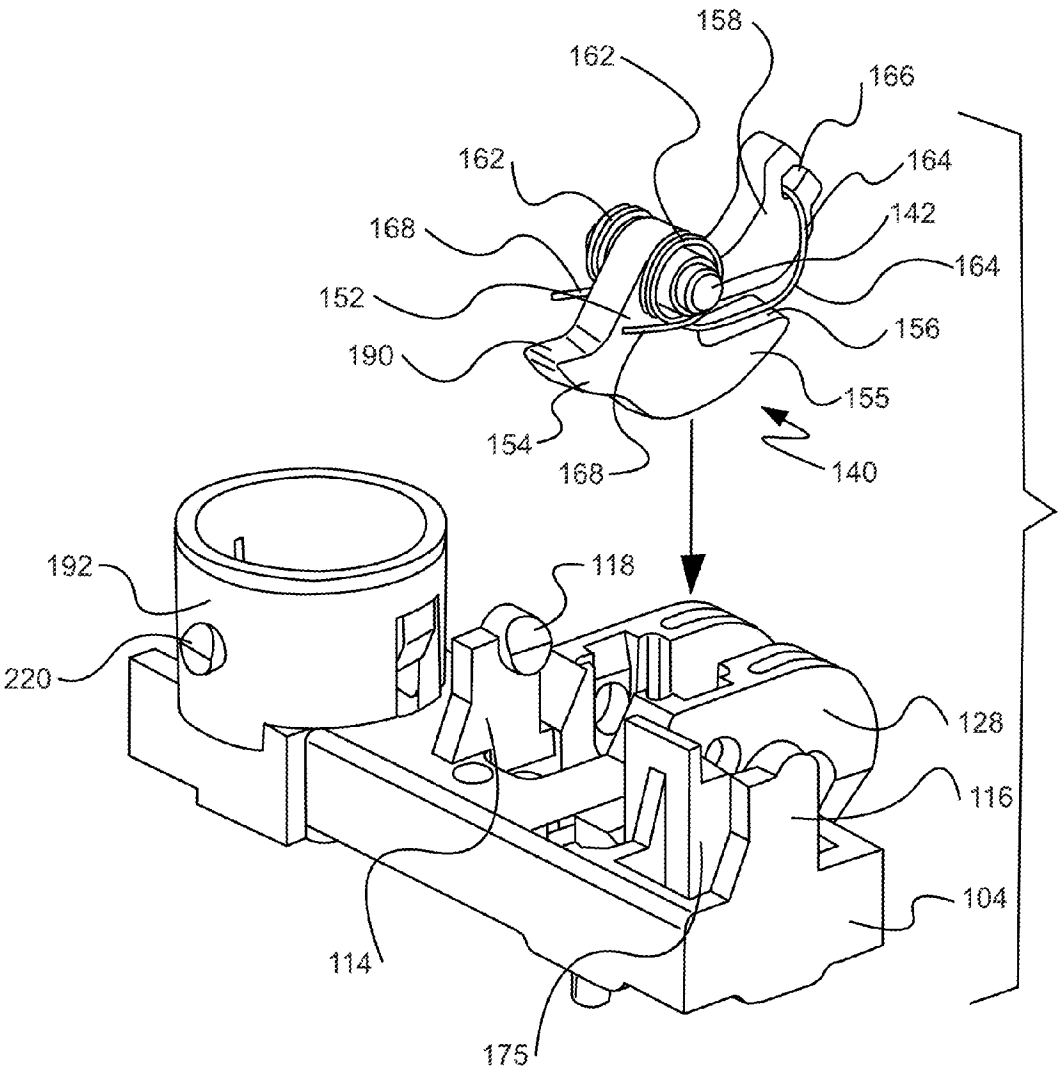
FIG. 59 illustrates the assembly of the pawl and pawl torsion spring to the frame or housing of the rotary pawl latch according to the present invention.
Figure 60:
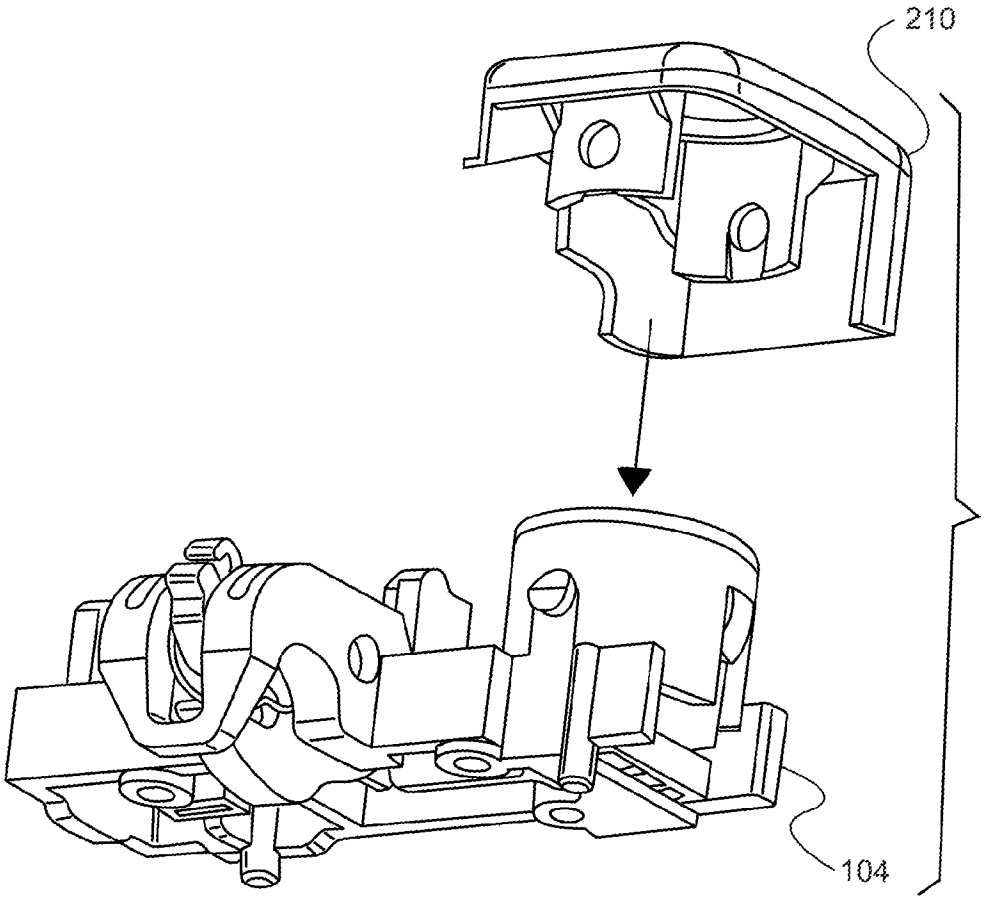
FIGS. 60-61 illustrate the sequence of assembly of the lock plug receptacle cover to the frame or housing of the rotary pawl latch according to the present invention.
Figure 61:
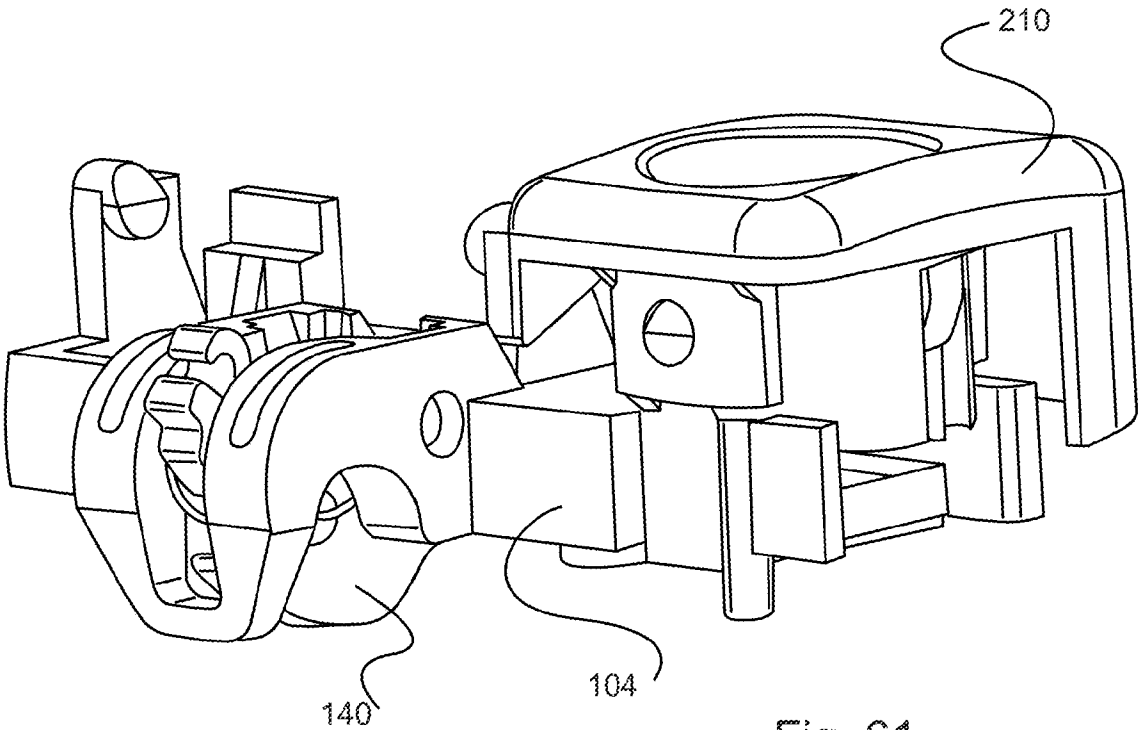
Figure 62:
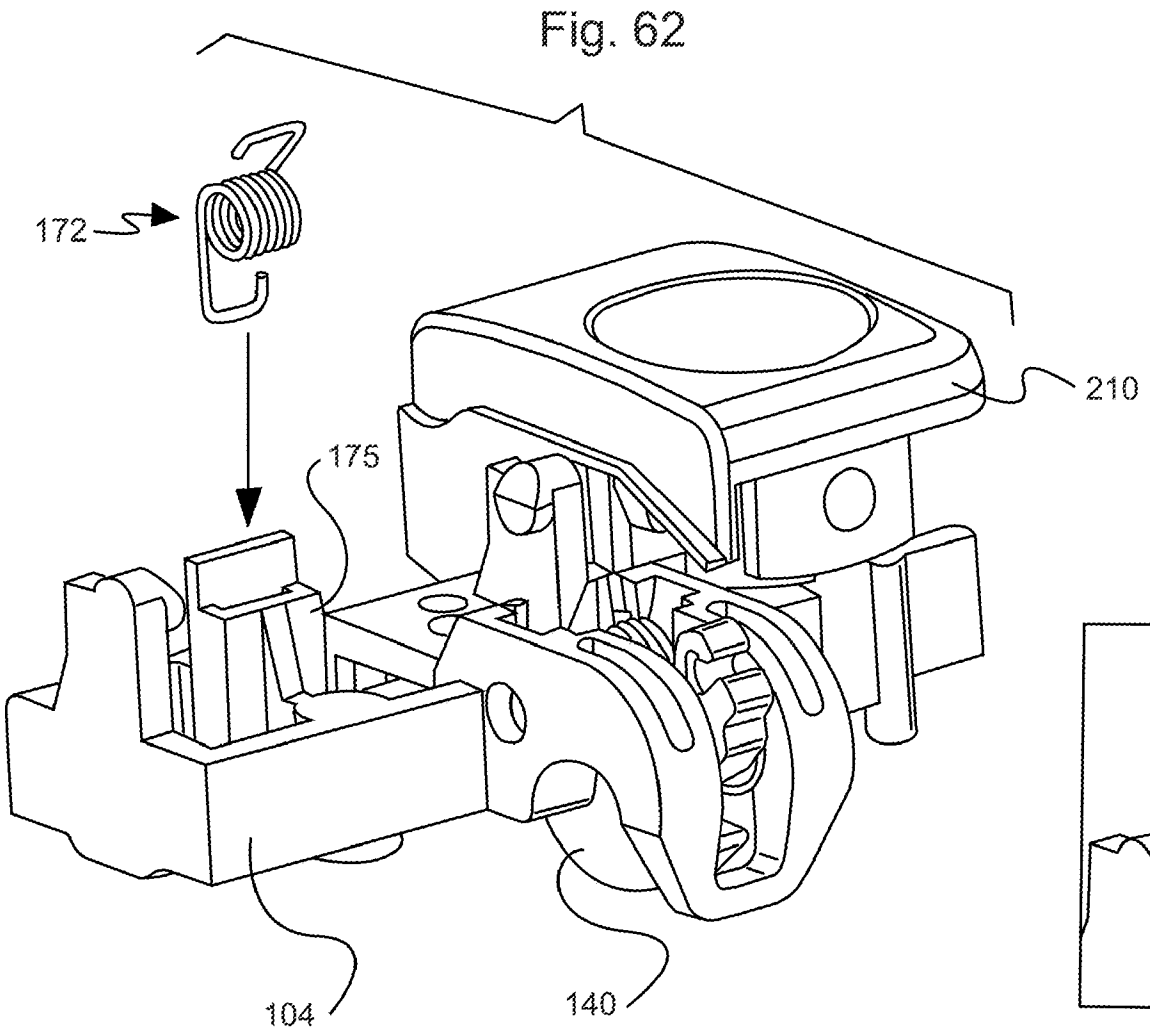
FIGS. 62-63 illustrate the sequence of assembly of the handle torsion spring to the frame or housing of the rotary pawl latch according to the present invention.
Figure 63:
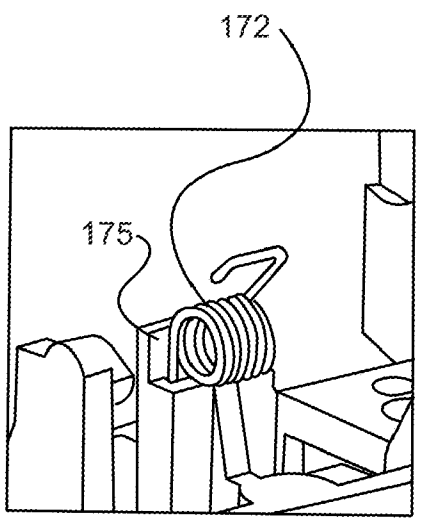
Figure 64:
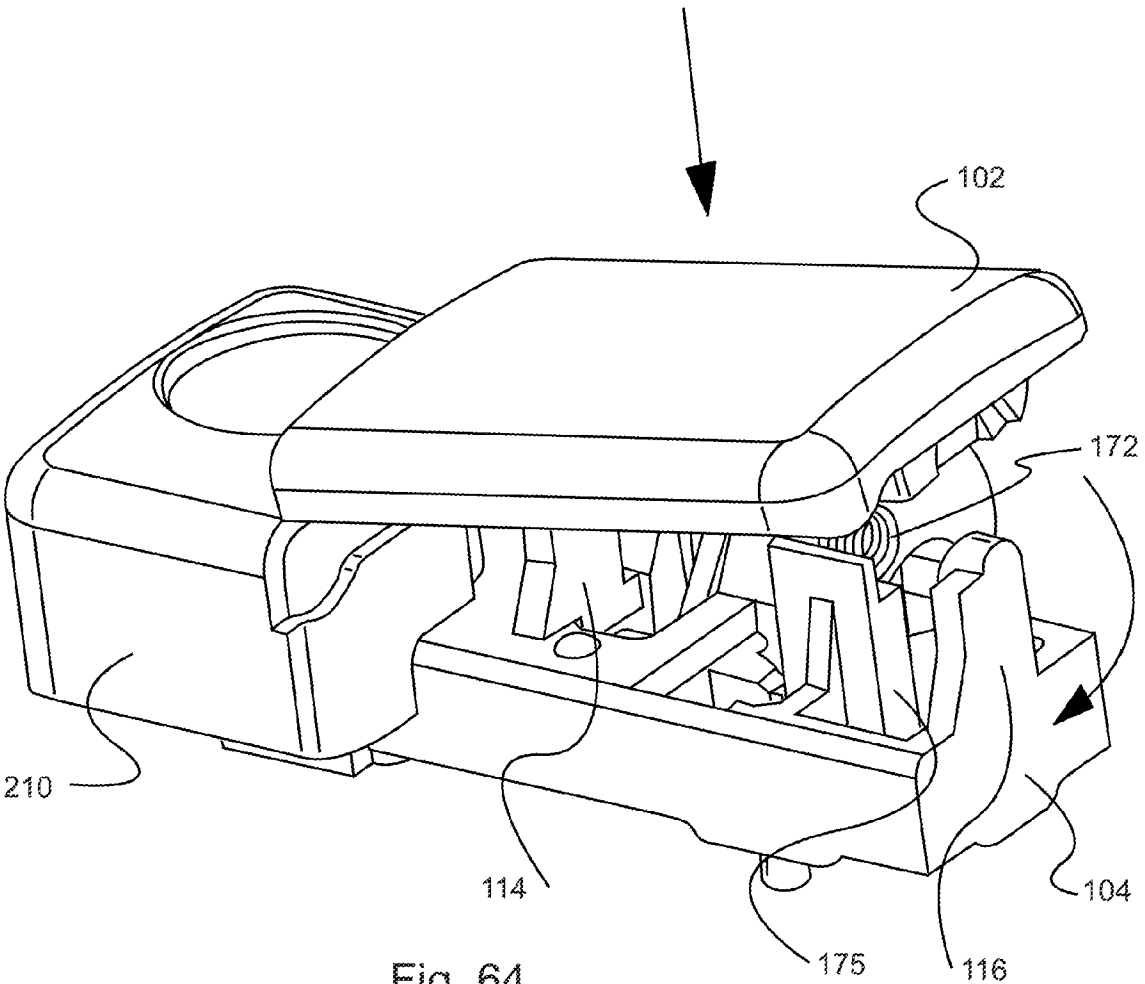
FIG. 64 illustrates the assembly of the handle to the frame or housing of the rotary pawl latch according to the present invention.
Figure 65:
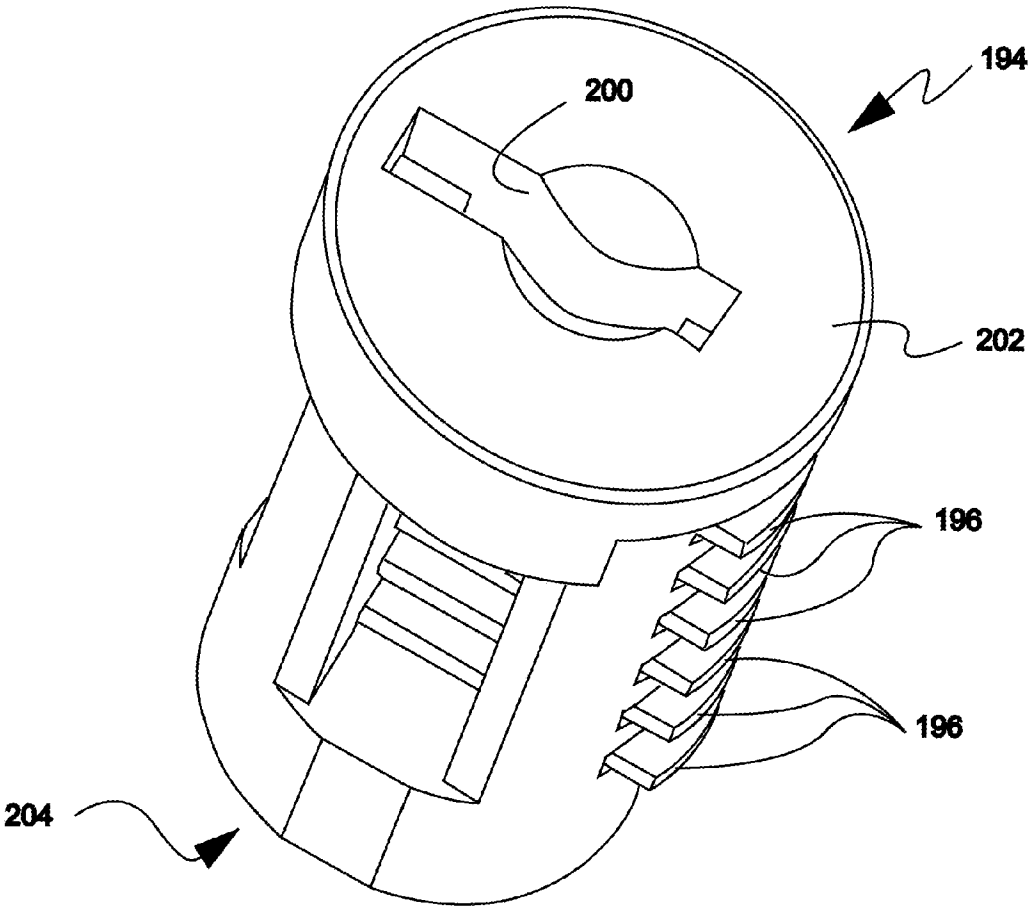
FIG. 65 is an isometric view of the lock plug of the rotary pawl latch according to the present invention.

Referring to FIGS. 1-65, a latch 100 made in accordance with the present invention can be seen. The latch 100 includes a latch housing or frame 104, a pawl 140, a locking member 138, means for selectively moving the locking member between locked and unlocked positions and means for selectively disengaging the locking member from the pawl while the locking member is in the unlocked position. In the illustrated embodiment, a handle 102 having an actuation arm 170 is provided for selectively disengaging the locking member 138 from the pawl 140 when the locking member 138 is in the unlocked position.

The latch 100 can be used for securing a first member in a closed position relative to a second member. A keeper is usually provided in a stationary position relative to the second member and the keeper is engaged by the latch 100 to secure the first member in the closed position. The first member may, for example, be the door of the glove box of an automobile and the second member may, for example, be the structure defining the glove box opening. The latch 100 is usually mounted such that the front of the latch including the front of the handle faces the exterior of the glove box door, and the rear of the latch 100 faces the interior of the glove box.

Preferably, the frame 104 has a portion that closes off the open end of the pawl slot 156 when the pawl 140 is in the latched position. This can be accomplished by providing for a portion of the frame 104 to obstruct the opening of the slot 156 when the pawl 140 is in the latched position. Furthermore, the frame is preferably adapted to allow an unobstructed path to the opening of the pawl slot 156 when the pawl 140 is in the unlatched position.

The latch 100 of the present invention is substantially identical in operation to that disclosed in U.S. Pat. No. 5,927,772, which is incorporated herein by reference. In the interest of brevity, the description herein will be directed in large part to the distinctions between the latch of the present invention and that disclosed in U.S. Pat. No. 5,927,772.

The rotary pawl latch 100 has an actuating member, such as, for example, the handle or paddle 102 that is pivotally mounted to the latch frame 104. The handle 102 is provided with flanges 106 and 108 which have holes 110 and 112, respectively. The frame 104 is provided with suitable means for the attachment of the handle 102 such as flanges 114 and 116 having projections 118 and 120, respectively. The projections 118 and 120 are received in holes 110 and 112, respectively, to pivotally attach the handle 102 to the frame 104. There are sloping surfaces ahead of the holes 110 and 112 so as to form ramps 122 and 124 which lead to the holes 110 and 112. The projections 118 and 120 are provided with beveled surfaces that align with the ramps 122 and 124 during assembly and by their interaction with the ramps 122 and 124 facilitate assembly. The flanges 114 and 116 and the flanges 106 and 108 have sufficient resilience such that the handle 102 can be snap-fitted to the frame 104. With the handle 102 positioned relative to the frame 104 such that the projections 118 and 120 register with the ramps 122 and 124, respectively, the handle 102 can be pressed toward the frame 104 until the projections 118 and 120 snap into the holes 110 and 112, respectively. Thus the handle 102 is pivotally attached to the frame 104. While a snap-fit handle attachment means is shown in the illustrated embodiment, it is conceivable that other fastening means such as pins, axles, bearings, and the like can also be employed. In addition it is possible for the positions of the holes 110 and 112 and the projections 118 and 120 to be reversed such that the projections 118 and 120 are provided on the handle 102 and the holes 110 and 112 are provided in the frame 104.

The handle 102 is also provided with shoulders 105 and 107 above the holes 110 and 112. The shoulders 105 and 107 are formed by surfaces that are sloping relative to the rear face 103 of the handle 102. Also, the shoulders 105 and 107 are sloping relative to the flanges 114 and 116 when the handle 102 is in the closed position. When the handle 102 reaches the open position the shoulders 105 and 107 contact the flanges 114 and 116 of the frame 104 and prevent further rotation of the handle 102 past the open position. The handle 102 also has a projection 109 that projects outward from the rear face 103 of the handle 102. When the handle 102 reaches the closed position the projection 109 contacts the front of the frame 104 and prevents further rotation of the handle 102 past the closed position. Thus, the shoulders 105, 107 and the projection 109 constitute means for limiting the rotation of the handle 102 and define the limits of the range of the rotational movement of the handle 102.

In the illustrated example, the frame 104 is provided with a body portion 126 having a hook-like member 128 projecting therefrom. Hook-like as used herein refers to any member that has a crook, curve, or bend to thereby catch on another member. The hook-like member or flange 128 has a tip 130 that points toward a keeper (not shown) as the first member to which the latch 100 is attached is moved to the closed position. A first slot 132 is provided within the portion of the frame body 126 and extends through the hook-like member 128. The locking member 138 includes a base 136 and an elongated locking arm 180. The elongated locking arm 180 is resiliently attached to the base 136. The frame 104 has a cavity 134 for receiving and supporting the base 136 such that the base 136 and the elongated locking arm 180, i.e. the locking member 138, can move back and forth rectilinearly parallel to the axis of rotation of the pawl 140 within a predetermined range of motion.

The latch assembly 100 also includes a pawl 140 shown rotationally connected to the latch frame 104 with suitable attachment means such as the pawl pivot members 142 which are provided at opposite sides of the pawl 140 and extend outward from the opposite sides of the pawl 140. Only one of the pivot members 142 is shown in the accompanying illustrations, the other being a mirror image of the illustrated pivot member 142. The pivot members 142 can also be provided as a single pivot member extending through the pawl 140. The pawl 140 is installed in the frame 104 by snap-fit placement of the pawl pivot members 142 into the pawl pivot holes 144, 146 disposed in opposite sides of the slot 132. Flared-out guide ramps 148, 150 are provided on either side of the slot 132. The Flared-out guide ramps 148, 150 lead to the holes 144, 146, respectively. The guide ramps 148, 150 guide the pawl pivot members 142 in the direction of the pawl pivot holes 144, 146 during the snap-fitting installation of the pawl 140 to the frame 104.

The pawl 140 has a body portion 152 with the pair of pawl pivot members 142 extending in opposite directions from either side of the body portion 152. The pawl 140 has a locking engagement portion or projection 154 that is involved in selectively retaining the pawl 140 in the latched position. The pawl 140 also has a pawl claw 155 and a pawl arm 158 extending from the pawl body 152. The pawl claw 155 and the pawl arm 158 cooperatively define the pawl slot 156, which is located between the two. The pawl claw 155 moves behind the keeper that is in stationary relationship with the second member as the pawl 140 rotates to the latched position in order to hold the first member in the closed position. The impact of the keeper on the pawl arm 158 causes the rotation of the pawl 140 to the latched position as the first member is moved to the closed position. The pawl slot 156 provides the necessary clearance for the pawl 140 to complete its rotation to the latched position while allowing the keeper to be positioned between the pawl arm 158 and the pawl claw 155 without any part of the pawl coming into conflict with the keeper in a way that would prevent the pawl from completing its rotation to the latched position.

In the preferred embodiment, the keeper member (not shown) may be attached to a stationary doorframe or a compartment opening at a position such that when a door to which the latch assembly 100 is attached is pivotally moved to the closed position, the keeper member will be positioned inside the crook or bend of the hook-like member 128. Furthermore, the keeper will impact and cause the rotation of the pawl 140 to the latched position wherein the keeper will become captured in the pawl slot 156.

It is possible to eliminate the pawl arm 158, and consequently the pawl slot 156, if the impact of the pawl claw 155 against the doorframe behind the keeper is used to rotate the pawl to the latched position. However, this arrangement would lead to excessive wear of the portion of the doorframe behind the keeper, which would be undesirable. Furthermore, in such an alternative embodiment the hook-like member 128 would have to be eliminated so that it would not interfere with contact between the pawl and the portion of the doorframe behind the keeper over the entire range of motion of the pawl. This modification would eliminate the added security and strength provided by the hook-like member 128.

The latch assembly 100 also includes a pawl torsion spring 160 having two coiled portions 162. The pawl torsion spring 160 is installed on the pawl 140 with each the coiled portions 162 surrounding a respective one of the pawl pivot members 142. The torsion spring 160 includes a wire loop 164 that engages the notch 166 in the arm portion 158. The wire loop 164 is joined to a respective coiled portion 162 at each end.

Lateral arms of the wire loop 164 extend from the respective coiled portions 162 to the notch 166 with the pawl arm 158 being positioned at least in part intermediate the lateral arms of the wire loop 164. The torsion spring 160 also has two tail portions 168. The pawl 140 is installed with the notch 166 positioned behind the pawl slot 156 as seen by an observer when the tip 130 faces toward the observer. In the fully assembled latch, each of the two tail portions 168 of the torsion spring 160 rests on a respective step 184 formed in either side of the slot 132. With the tail portions 168 of the torsion spring 160 positioned along the steps 184, the wire loop 164 engaging the notch 166 exerts a force on the arm portion 158 of the pawl 140 that biases the pawl 140 toward the open or unlatched position.

The handle 102 has an actuation arm 170 that extends toward the frame 104. A torsion spring 172 is provided between the handle 102 and the frame 104 that biases the handle 102 toward the closed position. The handle torsion spring 172 has a coiled portion 171 and two arms 173. The arms 173 have hooked ends. One of the arms 173 is received in a pocket 175 that that is provided as part of the frame 104. The arm 173 is positioned horizontally once it is received in the pocket 175. The pocket 175 extends horizontally from the front of the frame 104 to the rear of the frame 104 and is open at least at the front of the frame 104 so as to receive one of the arms 173 of the handle torsion spring 172. The other arm 173 of the handle torsion spring 172 presses against the rear face 103 of the handle 102 above the pivot axis of the handle 102, i.e. on the side of the pivot axis of the handle that is opposite the grasping portion 101 of the handle 102. With the handle torsion spring 172 in this position, moving the handle 102 toward the open position forces the arms 173 of the handle torsion spring 172 closer to each other. When the handle 102 is released the arms 173 of the handle torsion spring tend to move apart thus forcing the handle 102 back to the closed position.

The actuation arm 170 of the handle 102 is provided to engage the actuator engaging end 174 of the elongated locking arm 180 of the locking member 138. The elongated locking arm 180 is provided to extend in front of the slot 176 in the frame body 104 when the locking member 138 is in the unlocked position. At the end opposite the actuator engaging end 174 the elongated locking arm 180 is resiliently attached in cantilever fashion to the base 136 which is supported in the cavity 134.

The actuating arm 170 extends through the slot 176 such that a portion of the actuating arm 170 is positioned over the actuator engaging end 174 of the locking member 138 when the locking member is in the unlocked position. The locking member 138 is also provided with a pawl engaging portion 178, positioned along the elongated locking arm 180, which engages the projection 154 of the pawl 140. The latch assembly 100 is actuated by lifting the grasping portion 101 of the handle 102 away from the frame 104 with the locking member in the unlocked position. The end 182 of the actuating arm 170, distal from the paddle 102, engages the actuator engaging end 174 of the locking member 138 and the actuator engaging end 174 is deflected away from the axis of rotation of the pawl 140. By moving the handle 102 to the open position, the elongated locking arm 180 of the locking member 138 is deflected sufficiently far from the axis of rotation of the pawl 140 such that the pawl engaging portion 178 of the locking member 138 is moved out of engagement with the projection 154 thereby freeing up the pawl 140 for rotation to the open position. The bias provided by the pawl torsion spring 160 moves the pawl 140 from its latched position, where the keeper would be captured by the pawl claw 155, and forces the pawl 140 to rotate to the open or unlatched position. The rotation of the pawl 140 to the unlatched position moves the pawl claw 155 such that the pawl claw no longer obstructs the keeper and the first member from being pulled away from one another. Thus, the keeper that was once captured in the pawl slot 156 may now be disengaged from the pawl 140. The first member that was being secured in the closed position by the latch 100 can then be opened. The keeper may be a U-shaped rod attached, for example, to the frame surrounding the opening of the compartment secured by the closure member to which the latch 100 is attached. Furthermore, any like suitable member such as a bar, claw, or other suitable attachment member may serve as a keeper.

With the elongated locking arm 180 of the locking member 138 deflected sufficiently far from the axis of rotation of the pawl 140 such that the pawl engaging portion 178 of the locking member 138 is moved out of engagement with the pawl 140, the locking member 138 is said to be in the deflected configuration. When the elongated locking arm 180 of the locking member 138 is in the same position as when it is retaining the pawl 140 in the latched position, the locking member 138 is said to be in the undeflected configuration.

Suitable mounting means are provided to retain the latch assembly 100 on a panel or closure member. For example, installation of the latch assembly 100 to a panel may be accomplished with screws, rivets or pins which engage the holes 188 for fastening of the latch assembly to a closure member, such as for example, the door of the glove box of an automobile.

The operation of the latch 100 during closing of the first member will now be described with the locking member in the unlocked position. When the closure member to which the latch 100 is mounted is being closed, the opening of the pawl slot 156 faces toward the keeper and is unobstructed by the hook-like member 128. As the closure member is slammed shut, the keeper passes between the tip 130 of the hook-like member 128 and the pawl claw 155 and impacts the pawl arm 158 causing the rotation of the pawl 140 to the latched position illustrated in the drawings. As the pawl 140 rotates to the latched position, the cam surface 186 cams the elongated locking arm 180 of the locking member 138 out of the way of the projection 154 so that the pawl 140 can rotate to the latched position under the force imparted to the pawl 140 by the keeper. Once the pawl 140 is in the closed or latched position, the locking member 138 will return to its undeflected configuration due to its own internal spring forces. In the undeflected configuration the elongated locking arm 180 of the locking member 138 catches the flat side 190 of the projection 154 to keep the pawl 140 in the latched position illustrated in FIGS. 1-12, thus capturing the keeper in the pawl slot 156 and securing the first member to which the latch 100 is mounted in the closed position.

The latch 100 is provided with means to lock the latch so as to prevent unauthorized access to the compartment secured by the latch 100. This is accomplished by providing a lock plug receptacle 192 as part of the frame 104. The receptacle 192 is adapted to receive a lock plug 194. The lock plug 194 is adapted for being selectively rotated between locked and unlocked positions by a user using a key. The lock plug is of a type having a series of wafers 196 that are normally biased to project from the lock plug 194 and engage a shoulder or step 198 in the receptacle 192 so as to prevent rotation of the lock plug 194 relative to the receptacle 192 between the locked position illustrated in FIGS. 2, 11, and 12 and the unlocked position illustrated in FIGS. 1, 3, 4, 10, 13, 14, 15, and 16. By inserting an appropriate key (not shown) in the key hole 200, the wafers 196 are retracted into the lock plug 194 and the lock plug can be rotated from the locked to the unlocked position and vice versa.

The lock plug has a keyhole end 202, a locking member engaging end 204, and a longitudinal axis about which the lock plug 194 is rotated to move the lock plug between locked and unlocked positions. A cylindrical projection 206 projects from the locking member engaging end 204 of the lock plug 194 and extends into a slot 208 formed in the base 136 of the locking member 138. The projection 206 is offset, i.e. is eccentric, relative to the longitudinal axis of the lock plug such that it moves along a circular arc as the lock plug is rotated. The projection 206 extends in a direction parallel to the longitudinal axis of the lock plug 194. As the projection 206 moves along its arc-shaped path resulting from the rotation of the lock plug 194 between locked and unlocked positions, the locking member 138 is moved rectilinearly between its locked and unlocked positions, respectively. When the locking member 138 is in the locked position and the pawl 140 is in the latched position, the actuator engaging end 174 of the locking member 138 is moved out from under the actuating arm 170. Thus, with the locking member 138 in the locked position, the handle 102 can be moved from the closed to the open position without the actuating arm 170 of the handle engaging the actuator engaging end 174 of the locking member 138. Accordingly, with the locking member in the locked position, actuating arm 170 cannot deflect the elongated locking arm 180 of the locking member 138 out of engagement with the pawl 140 and the pawl 140 will remain in the latched position even when the handle 102 is moved from the closed to the open position. Therefore, the latch 100 cannot be opened with the locking member in the locked position even if the handle 102 is moved to the open position.

Turning the lock plug 194 to the unlocked position when the pawl 140 is in the latched positions causes the actuator engaging end 174 of the locking member 138 to once again be positioned under the actuating arm 170 such that movement of the handle 102 to the open position will disengage the locking member 138 from the pawl to 140 to thereby allow the latch to be opened.

The latch 100 is also provided with a lock plug receptacle cover 210 attached to the lock plug receptacle 192. The lock plug receptacle cover 210 is separate from the handle 102 and does not move relative to the frame 104 during operation of the latch 100. The lock plug receptacle cover 210 acts to increase resistance of the latch 100 to tampering by preventing or deterring the insertion of tools or instruments into the latch mechanism or the area of the lock plug when the handle is lifted to the open position. The lock plug receptacle cover 210 has a front face 212, a pair of partial sleeves 214 projecting from the backside of the front face 212, and a lock plug access opening 216. The partial sleeves 214 are positioned on opposite sides of the access opening 216. Each of the partial sleeves 214 is provided with a hole 218. The lock plug receptacle 192 is provided with projections 220 on the outside surface thereof. The projections 220 are received in holes 218 to attach the lock plug receptacle cover 210 to the lock plug receptacle 192. There are sloping surfaces ahead of the holes 218 so as to form ramps 222 that lead to the holes 218. Also the projections 220 are provided with beveled surfaces that align with the ramps 222 during assembly and by their interaction with the ramps 222 facilitate assembly. The partial sleeves 214 are resilient such that the lock plug receptacle cover 210 can be snap-fitted to the lock plug receptacle 192. With the lock plug receptacle cover 210 positioned relative to the lock plug receptacle 192 such that the projections 220 register with the ramps 222, the lock plug receptacle cover 210 can be pressed toward the frame 104 until the projections 220 snap into the holes 218. Thus the lock plug receptacle cover 210 is attached to the lock plug receptacle 192 and consequently the frame 104.

The frame 104 also has a projecting fin 224 positioned under the elongated locking arm 180 of the locking member 138. The locking member 138 has an open-ended slot 226 that registers with the fin 224 when the locking member 138 is in the unlocked position. The slot 226 provides clearance for the fin 224 such that the elongated locking arm 180 can be deflected out of engagement with the pawl to release the pawl from the latched position without interference from the fin 224. When the locking member 138 is in the locked position, the fin 224 interferes with the movement of the elongated locking arm 180 such that the elongated locking arm 180 cannot be deflected out of engagement with the pawl to release the pawl from the latched position. This feature has the advantage that it prevents the elongated locking arm 180 from being deflected out of engagement with the pawl by insertion of some tool or instrument through the slot 176 to release the pawl from the latched position without the proper key and, therefore, enhances the tamper resistance of the latch 100.

In addition, the locking member 138 includes a projection 228 that extends upward from the pawl engaging portion 178. The projection 228 is positioned intermediate the actuator engaging end 174 and the pawl 140 when the locking member 138 is in the unlocked position. Both the projection 228 and the portion of the pawl engaging portion 178 adjacent the projection 228 in the direction of the base 136 can engage the flat side 190 of the projection 154 to retain the pawl 140 in the latched position. However, the projection 228 can still clear the pawl body 152 in the direction of the lock plug receptacle 192, such that the locking member 138 can be moved to the locked position with the pawl 140 in the latched position. When the Pawl 140 is in the unlatched position, the pawl body 152 interferes with the projection 228. Thus, when the Pawl 140 is in the unlatched position, the projection 228 prevents the locking member 138 from being moved to the locked position. Because of the fin 224, the elongated locking arm 180 of the locking member 138 cannot be deflected enough to allow movement of the pawl into or out of the latched position when the locking member 138 is in the locked position. Accordingly, if the locking member 138 could be moved to the locked position with the pawl 140 in the unlatched position, the latch 100 would not work properly and would not latch when the closure member to which the latch is attached is slammed shut. Furthermore, the impact of the keeper on the pawl 140 in this situation could cause damage to the pawl 140 and the locking member 138. Advantageously, in the illustrated example the slot 226 is positioned under the projection 228 such that the elongated locking arm 180 of the locking member 138 will not be weakened by the presence of the slot 226.

It will be apparent to those skilled in the art that various modifications can be made to the latch of the present invention without departing from the scope and spirit of the invention, and it is intended that the present invention cover modifications and variations of the latch which are within the scope of the appended claims and their equivalents.

The invention claimed is:

1. A latch assembly for releasably securing a first member in a closed position relative to a second member, the second member having a keeper in a fixed positional relationship therewith, the latch assembly comprising:

a frame adapted for attachment to the first member, said frame being provided with a pocket;

a pawl rotationally supported by said frame, said pawl being rotationally movable between latched and unlatched positions;

a locking member supported by said frame, said locking member being rectilinearly movable between locked and unlocked positions, said locking member also being capable of assuming a deflected configuration at least when said locking member is in said unlocked position, said locking member also being capable of assuming an undeflected configuration, said locking member engaging and retaining said pawl in said latched position when said pawl is in said latched position and said locking member is in said undeflected configuration, said locking member releasing said pawl from said latched position when said locking member assumes said deflected configuration while said locking member is in said unlocked position;

a handle pivotally attached to said frame and being movable between a closed position and an open position, said handle causing said locking member to assume said deflected configuration when said locking member is in said unlocked position and said handle is moved to the open position, said locking member being positioned in said locked position such that said locking member cannot be engaged by said handle, said handle having a grasping portion and a rear face and pivotally moving about a pivot axis;

a lock plug supported by said frame, said lock plug being adapted for being selectively rotated between locked and unlocked positions by a user using a key, said lock plug engaging said locking member such that rotation of said lock plug between locked and unlocked positions moves said locking member between locked and unlocked positions, respectively; and a handle torsion spring supported by said frame, said handle torsion spring having a coiled portion and two arms, one of said arms of said handle torsion spring being received in said pocket and another of said arms of said handle torsion spring pressing against said rear face of said handle on the side of said pivot axis of said handle that is opposite said grasping portion of said handle such that said handle torsion spring biases said handle toward said closed position.

2. The latch assembly according to claim 1, wherein said frame has a lock plug receptacle, the latch assembly further comprising:

a lock plug receptacle cover attached to said lock plug receptacle, said lock plug receptacle cover being separate from said handle and acting to increase resistance of said latch assembly to tampering.

3. The latch assembly according to claim 2, wherein said lock plug receptacle cover has a pair of partial sleeves projecting from one side thereof, said pair of partial sleeves being adapted for snap-fit attachment to said frame.

4. The latch assembly according to claim 3, wherein said pair of partial sleeves are positioned around said lock plug receptacle.

5. The latch assembly according to claim 4, wherein said lock plug receptacle is provided with a pair of projections and each of said pair of partial sleeves is provided with a hole, and wherein each of said pair of projections is received in said hole of a respective one of said pair of partial sleeves in order to attach said lock plug receptacle cover to said frame.

6. The latch assembly according to claim 5, wherein each of said pair of partial sleeves is provided with a ramp that leads to said hole of each of said pair of partial sleeves that facilitate attachment of said lock plug receptacle cover to said frame through snap-fit attachment.

7. A latch assembly for releasably securing a first member in a closed position relative to a second member, the second member having a keeper in a fixed positional relationship therewith, the latch assembly comprising:

a frame adapted for attachment to the first member;

a pawl rotationally supported by said frame, said pawl being rotationally movable between latched and unlatched positions;

a locking member supported by said frame, said locking member being rectilinearly movable between locked and unlocked positions, said locking member also being capable of assuming a deflected configuration at least when said locking member is in said unlocked position, said locking member also being capable of assuming an undeflected configuration, said locking member engaging and retaining said pawl in said latched position when said pawl is in said latched position and said locking member is in said undeflected configuration, said locking member releasing said pawl from said latched position when said locking member assumes said deflected configuration while said locking member is in said unlocked position;

a handle pivotally attached to said frame and being movable between a closed position and an open position, said handle causing said locking member to assume said deflected configuration when said locking member is in said unlocked position and said handle is moved to the open position;

a lock plug supported by said frame, said lock plug being adapted for being selectively rotated between locked and unlocked positions by a user using a key, said lock plug engaging said locking member such that rotation of said lock plug between locked and unlocked positions moves said locking member between locked and unlocked positions, respectively; and biasing means for biasing said handle toward said closed position, wherein said frame includes a fin, wherein said locking member has an open-ended slot that registers with said fin when said locking member is in said unlocked position such that said slot provides clearance for said fin to thereby allow said locking member to be deflected out of engagement with said pawl to release said pawl from said latched position without interference from said fin, and wherein when said locking member is in said locked position, said fin prevents said locking member from being deflected out of engagement with said pawl for releasing said pawl from said latched position.

8. The latch assembly according to claim 7, wherein said frame being provided with a pocket, wherein said handle having a grasping portion and a rear face and pivotally moving about a pivot axis, and wherein said biasing means for biasing said handle is a handle torsion spring supported by said frame, said handle torsion spring having a coiled portion and two arms, one of said arms of said handle torsion spring being received in said pocket and another of said arms of said handle torsion spring pressing against said rear face of said handle on the side of said pivot axis of said handle that is opposite said grasping portion of said handle such that said handle torsion spring biases said handle toward said closed position.

9. The latch assembly according to any one of claims 7 and 8, wherein said frame has a lock plug receptacle, the latch assembly further comprising:

a lock plug receptacle cover attached to said lock plug receptacle, said lock plug receptacle cover being separate from said handle and acting to increase resistance of said latch assembly to tampering.

10. The latch assembly according to claim 9, wherein said lock plug receptacle cover has a pair of partial sleeves projecting from one side thereof, said pair of partial sleeves being adapted for snap-fit attachment to said frame.

11. The latch assembly according to claim 10, wherein said pair of partial sleeves are positioned around said lock plug receptacle.

12. The latch assembly according to claim 11, wherein said lock plug receptacle is provided with a pair of projections and each of said pair of partial sleeves is provided with a hole, and wherein each of said pair of projections is received in said hole of a respective one of said pair of partial sleeves in order to attach said lock plug receptacle cover to said frame.

13. The latch assembly according to claim 12, wherein each of said pair of partial sleeves is provided with a ramp that leads to said hole of each of said pair of partial sleeves that facilitate attachment of said lock plug receptacle cover to said frame through snap-fit attachment.

14. The latch assembly according to claim 7, wherein said biasing means for biasing said handle is a handle torsion spring supported by said frame.

15. The latch assembly according to any one of claims 7 and 14, wherein said frame has a lock plug receptacle for supporting said lock plug, the latch assembly further comprising:

a lock plug receptacle cover attached to said lock plug receptacle, said lock plug receptacle cover being separate from said handle and acting to increase resistance of said latch assembly to tampering.

16. The latch assembly according to claim 15, wherein said lock plug receptacle cover has a pair of partial sleeves projecting from one side thereof, said pair of partial sleeves being adapted for snap-fit attachment to said frame.

17. The latch assembly according to claim 16, wherein said pair of partial sleeves are positioned around said lock plug receptacle.

18. The latch assembly according to claim 17, wherein said lock plug receptacle is provided with a pair of projections and each of said pair of partial sleeves is provided with a hole, and wherein each of said pair of projections is received in said hole of a respective one of said pair of partial sleeves in order to attach said lock plug receptacle cover to said frame.

19. The latch assembly according to claim 18, wherein each of said pair of partial sleeves is provided with a ramp that leads to said hole of each of said pair of partial sleeves that facilitate attachment of said lock plug receptacle cover to said frame through snap-fit attachment.

* * * * *